United States Patent [19]

Lawson

[11] 4,298,064

[45] Nov. 3, 1981

[54] REMOTELY OPERATED COUPLING AND WELL DEVICES EMPLOYING SAME

[75] Inventor: John E. Lawson, London, England

[73] Assignee: Armco Inc., Middletown, Ohio

[21] Appl. No.: 120,047

[22] Filed: Feb. 11, 1980

[51] Int. Cl.[3] ..... E21B 33/035

[52] U.S. Cl. ..... 166/75 A; 285/18; 285/319

[58] Field of Search ..... 166/75 A, 339, 338, 166/340, 360, 345, 344, 341, 358, 342, 343, 315; 285/18, 137 A, 27, 29, DIG. 21, DIG. 15

[56] References Cited

U.S. PATENT DOCUMENTS 3,222,088 12/1965 Haeber ..... 285/319 X
3,492,027 1/1970 Hevrin ..... 285/18
3,554,579 1/1971 Brown ..... 285/18
3,608,932 9/1971 Brown ..... 285/18
4,057,267 11/1977 Janser, Jr. ..... 285/18

*Primary Examiner*—William F. Pate, III
*Attorney, Agent, or Firm*—Roylance, Abrams, Berdo & Farley

[57] ABSTRACT

A coupling device, especially for well tools, for connecting a load, such as a tubing hanger from which tubing strings depend, to an upper member, such as a handling tool, from which the load is to be suspended, with capability of remote operation of the coupling device to disconnect the load and to reconnect. To provide heavy load capability when only a relatively small space is available for the coupling, coupling segments of generally C-shaped radial cross section are employed, the segments being actuated by a piston moved axially of the coupling.

14 Claims, 27 Drawing Figures

REMOTELY OPERATED COUPLING AND WELL DEVICES EMPLOYING SAME

This invention relates to couplings which can be remotely operated and to well devices embodying the coupling.

RELATED APPLICATIONS

Subject matter disclosed in this application is also disclosed and claimed in my copending applications Ser. Nos. 120,044, 120,851, 120,046, 120,045, 120,695 and 120,695, filed concurrently herewith.

BACKGROUND OF THE INVENTION

In numerous instances, and particularly in completion of underwater oil and gas wells, it is necessary to connect a load to an upper member from which the load is to be suspended, with the weight of the load being large, the space available to accomplish the coupling being transversely small, and with the requirement that operation of the coupling be accomplished remotely. One example of such a requirement arises in the suspension of tubing strings in an underwater well, the tubing strings depending from a tubing hanger which must be landed in a wellhead structure, on the floor of the body of water, by a handling string connected to the tubing hanger by a handling tool, the handling string being manipulated from a vessel or other operational base at the surface of the body of water. Weight of the tubing strings is as much as 300,000 pounds or more. The wellhead or like structure may be in deep water, frequently beyond the depths at which a diver can operate, so that all operations must be accomplished remotely, from the operational base at the surface. And the space available for coupling between the tubing hanger and the handling tool is relatively small, typically a cylindrical bore of a diameter on the order of 13 inches. Further, while the handling tool can be attached to the tubing hanger by direct manual operation on the operational base, before the hanger is run in and landed on its intended support in the wellhead or like structure, subsequent disconnection of the handling tool from the tubing hanger, after successfully landing the hanger, must be accomplished remotely, and it may thereafter be necessary to retrieve the tubing hanger and tubing strings, in which case re-connection of the handling tool to the hanger must be accomplished remotely. While much work has been done in this field in the past, there has been a continuing need for an improved remotely operated coupling.

OBJECTS OF THE INVENTION

A general object is to devise an improved remotely operated coupling for connecting a heavy load to a member from which the load is to be suspended when the space available for the coupling is small.

Another object is to provide such a coupling which is capable of supporting heavy loads but can be remotely operated to disconnect with certainty.

A further object is to provide improved well devices, typically handling tools, embodying such a coupling, with the nature of the coupling being such that adequate space remains for other necessary components of the well device.

SUMMARY OF THE INVENTION

Couplings according to the invention include a first member, typically the body of a hanger from which pipe is suspended, and a coupling member, typically forming part of a handling tool. The first member has a first frustoconical shoulder, while the coupling member presents a second frustoconical shoulder which can be spaced below the first shoulder so as to be parallel thereto, the two shoulders then being spaced apart to define an annular space. The coupling member carries a piston which can be selectively driven upwardly and downwardly relative to the coupling member and which has an annular segment-retaining groove defined by mutually parallel upper and lower side walls which taper in a direction opposite to the direction in which the first and second shoulders taper. A plurality of arcuate coupling segments of generally C-shaped radial cross section are arranged in an annular series with the upper portions slidably accommodated within the segment-retaining groove of the piston. The lower portions of the segments are disposed to move into the annular space between the first and second shoulders when, with the coupling member properly positioned relative to the first member, the piston is driven downwardly. With the load to be suspended then being applied to the first member, the lower portions of the coupling segments are clamped between the first and second shoulders and the load is thus transmitted from the first member to the coupling member via the lower portions of the coupling segments. When it is desired to disconnect the coupling member from the first member (the latter then having been landed on a support so that the heavy load is no longer applied through the coupling segments), the piston is driven upwardly and the coupling segments move upwardly and outwardly to withdraw the lower portions of the segments from the annular space between the first and second segments, the movement of the lower portions of the segments being parallel to the frustoconical shoulders. An annular recess of generally C-shaped radial cross section is provided by the coupling member to accommodate the coupling segments after such withdrawal.

IDENTIFICATION OF THE DRAWINGS

In order that the manner in which the foregoing and other objects are achieved according to the invention can be understood in detail, particularly advantageous embodiments thereof will be described with reference to the accompanying drawings, which form part of the original disclosure of this application, and wherein.

DETAILED DESCRIPTION OF THE APPARATUS

Figure 1:
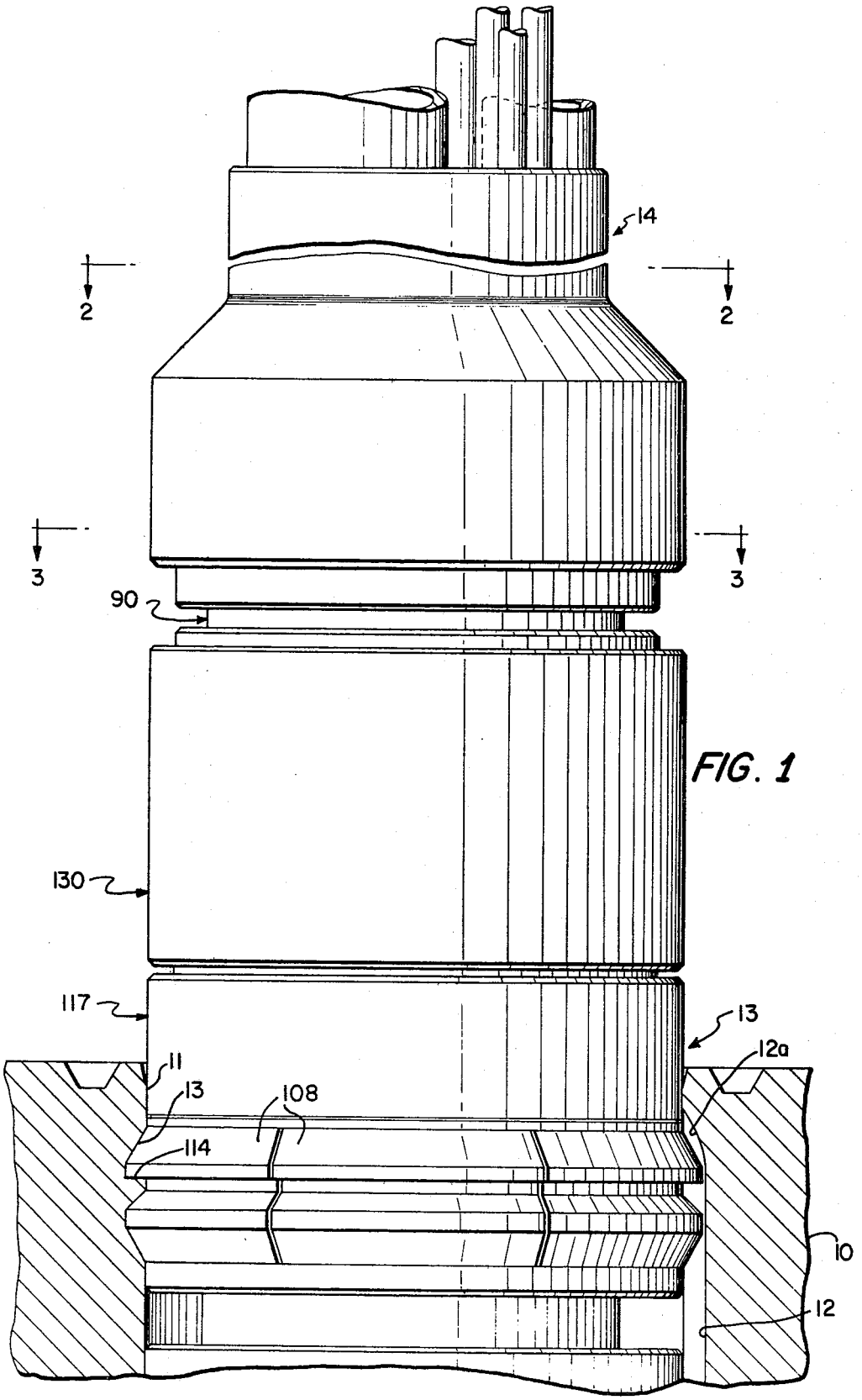
FIGS. 1–1B are side elevational views, with some parts shown in vertical cross section, which combine to illustrate apparatus for orienting and landing a multiple string tubing hanger, with the hanger connected to a handling tool by a coupling according to the invention, the views being taken after the tubing hanger has been landed.
Figure 1A:
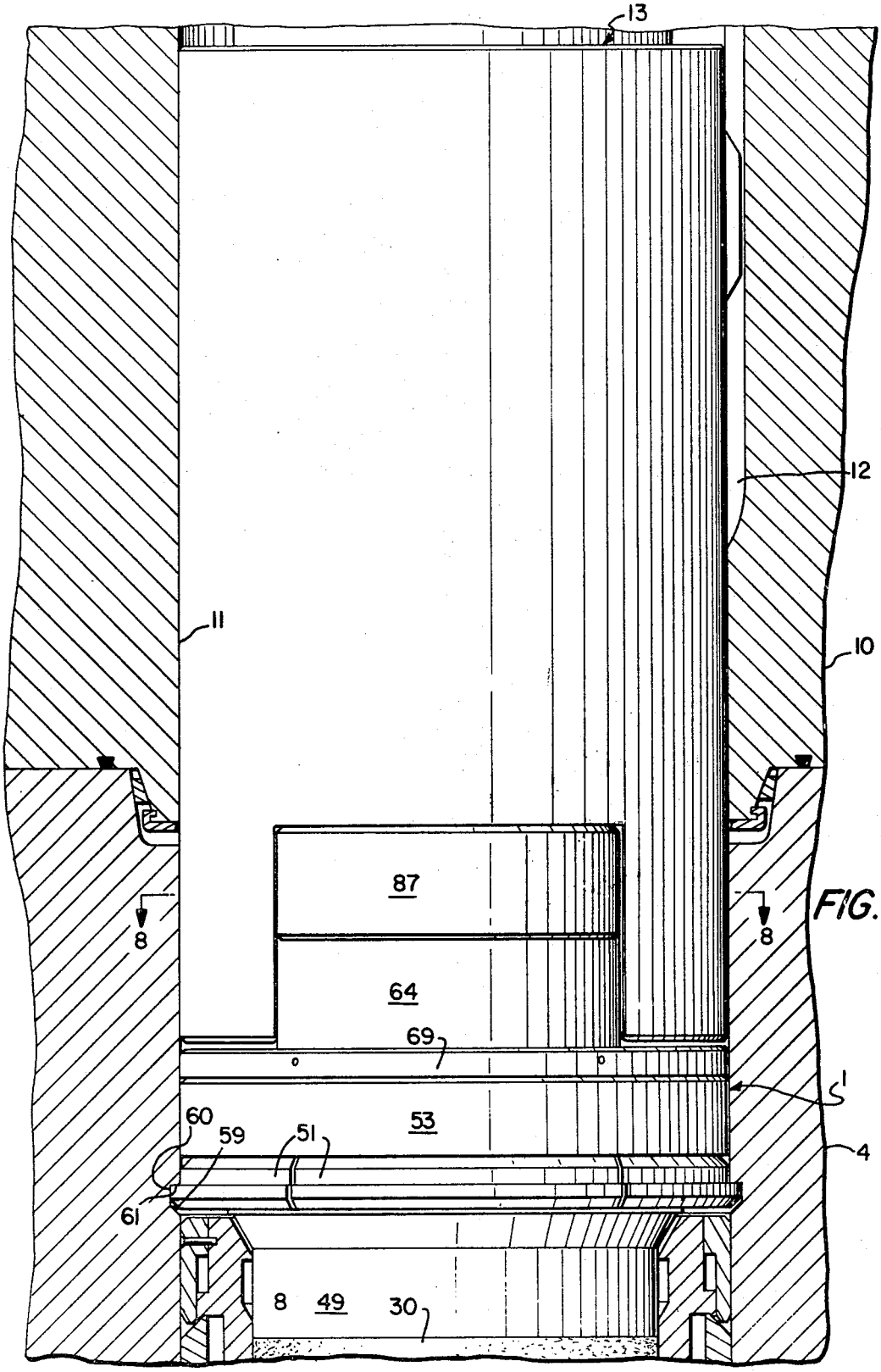
Figure 1B:
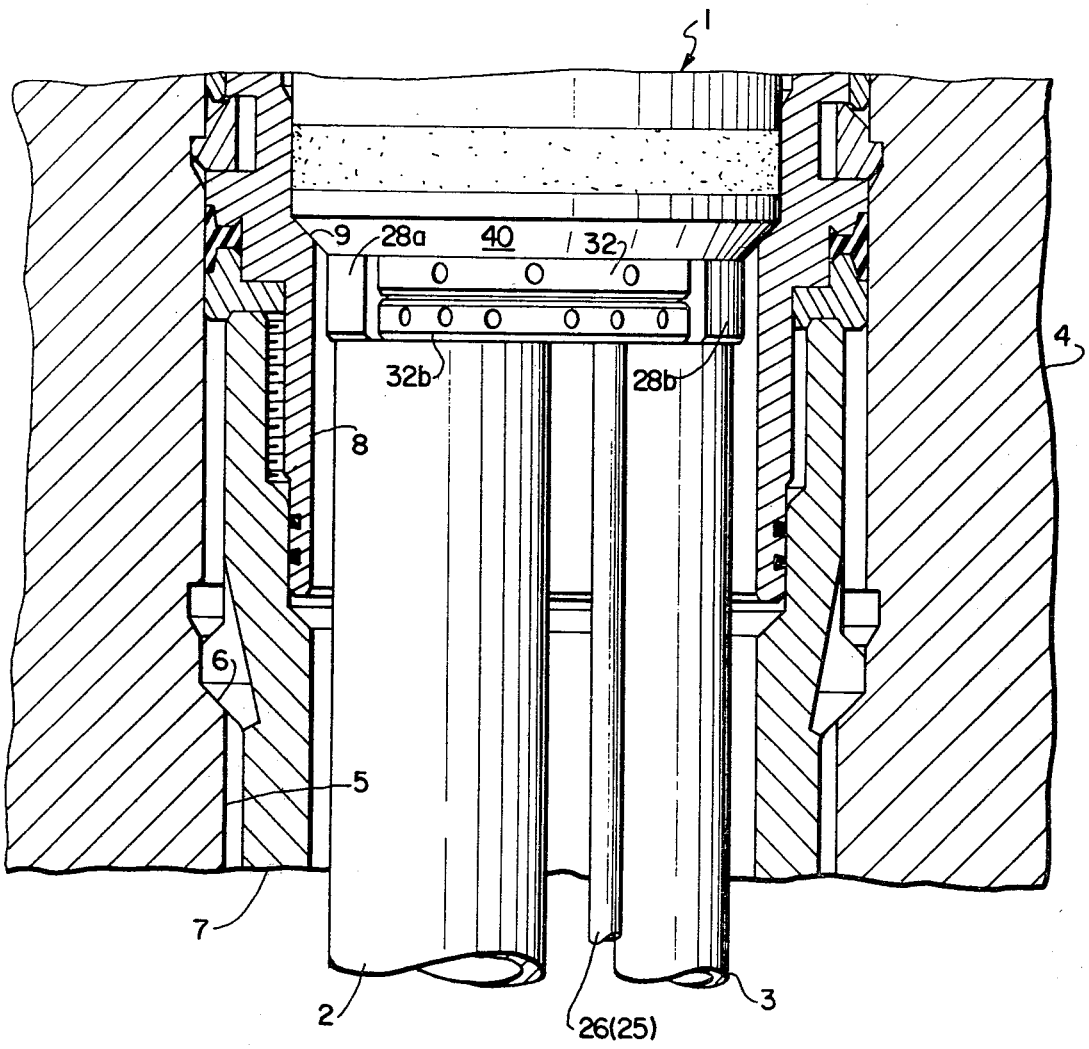

FIGS. 1–22 illustrate one apparatus embodiment of the invention, that embodiment being adapted for installation of a tubing hanger 1, with tubing strings 2 and 3 depending therefrom, in an underwater well structure comprising a wellhead lower body 4 located at the floor of the body of water and having an upright through bore 5 which is formed with an upwardly facing transverse annular shoulder 6, FIG. 1B, on which a casing hanger 7 is seated. Casing hanger 7 supports a packoff device 8 having a through bore which includes the upwardly directed transverse annular support shoulder 9 on which tubing hanger 1 is to be landed. A drilling upper body 10, FIGS. 1 and 1A, is seated on lower body 4 and secured thereto in conventional fashion. Upper body 10 has an upright through bore 11 which forms a continuation of bore 5 so that bores 5 and 11 combine to define an upright passage extending above hanger 7 and opening through the top of body 10, this passage being coaxial with annular support shoulder 9.

Body 10 is equipped with a vertical slot 12, FIGS. 1 and 1A, which opens inwardly to provide a rotational orientation reference accessible via bore 11. It will be understood by those skilled in the underwater well art that bodies 4 and 10, as well as other components of the well structure, are installed by remote operations carried out from a vessel, platform or other operational base at the surface of the body of water with the aid of a conventional guidance system (not shown) such as that described in U.S. Pat. No. 2,808,229 issued Oct. 1, 1957, to Bauer et al, so that orientation reference slot 12 occupies a known position relative to, e.g., the guide posts of the guidance system. Slot 12 is of uniform depth and width and is of substantial length, extending for most of the length of bore 11. At the upper end of slot 12, the bottom wall of the slot is curved smoothly to join the wall of bore 11, providing a camming surface at 12*a*, FIG. 1.

To manipulate tubing hanger 1 during final running in of tubing strings 2 and 3 and orientation and landing of the tubing hanger, the invention employs a multifunction handling tool, indicated generally at 13, a relatively short composite riser section, indicated generally at 14, FIG. 1, and described in detail in aforementioned copending application Ser. No. 120,044, and a suitable handling string (not shown) which can be as described in the aforementioned application Ser. No. 36,659 of Michael L. Wilson. Working at the operational base, tubing hanger 1 is attached to handling tool 13 by the coupling indicated generally at 15, FIG. 11B. The handling tool is then attached to composite riser section 14, and the handling string then attached to the riser section so that the combination of tubing hanger 1 (with tubing strings 2, 3 depending therefrom), handling tool 13 and riser section 14 can be lowered into place by manipulating the handling string with the aid of the guidance system.

Tubing Hanger 1

Figure 8:
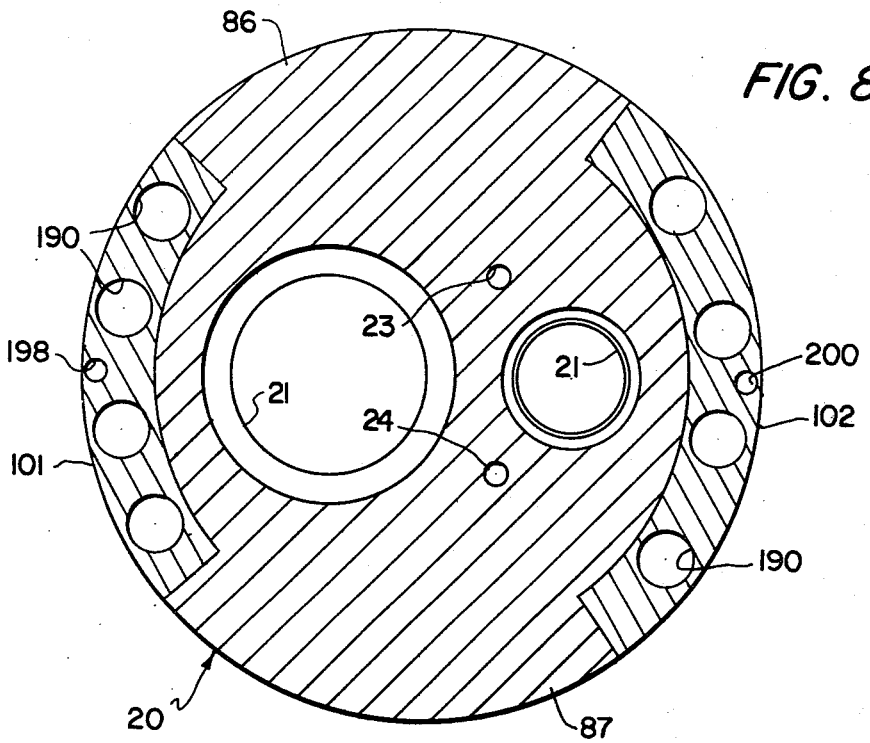
FIG. 8 is a transverse cross-sectional view taken generally on line 8—8, FIG. 1A.
Figure 9:
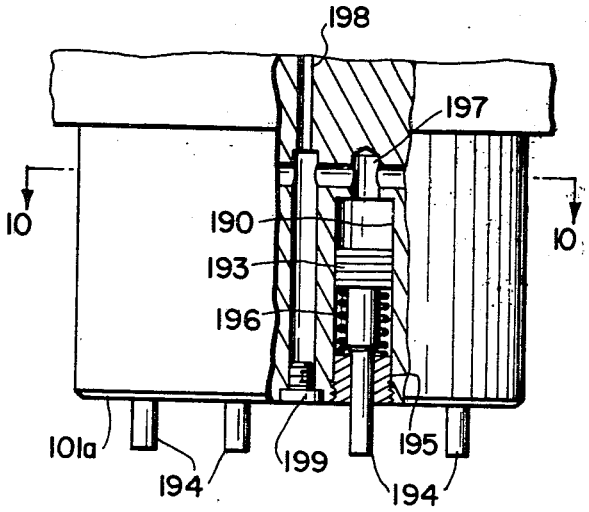
FIG. 9 is a fragmentary side elevational view of a portion of the structure seen in FIG. 8, with portions broken away for clarity.
Figure 10:
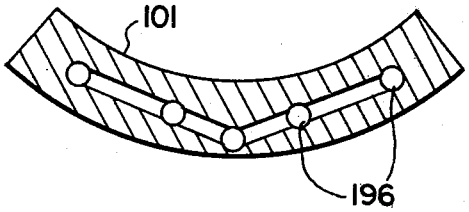
FIG. 10 is a transverse cross-sectional view taken generally on line 10—10, FIG. 9.

Tubing hanger 1 comprises a main body 20 having through bores 21 and 22 to communicate with tubing strings 2 and 3, respectively, and through bores 23 and 24, FIG. 8, to communicate respectively with hydraulic lines 25 and 26, FIG. 1B, which extend to conventional downhole safety valves (not shown). The lower end portions of bores 21–24 are internally threaded so that the tubing strings can be attached conventionally to hanger body 20.

Figure 18:
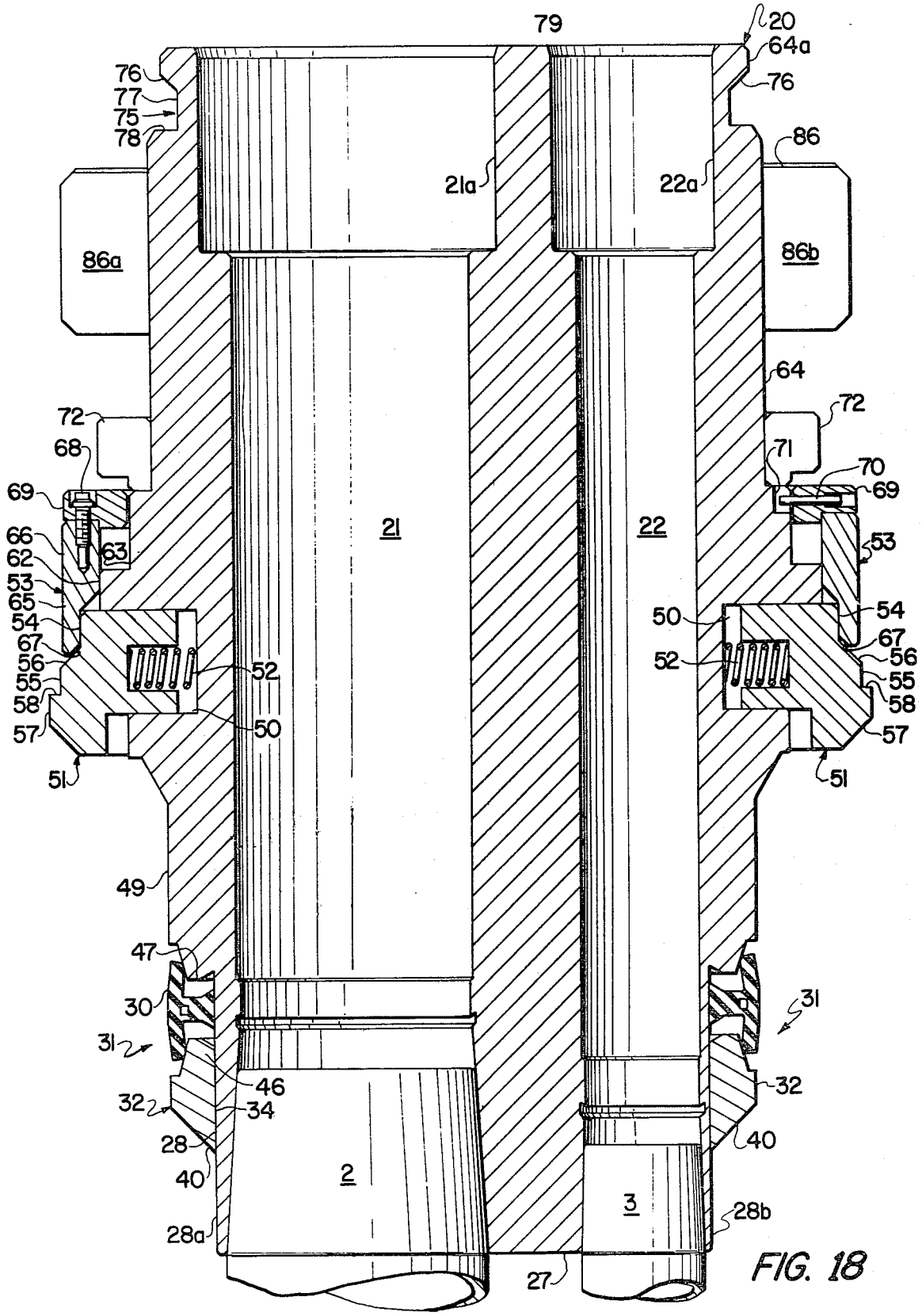
FIG. 18 is a vertical sectional view taken generally on line 18—18, FIG. 17.
Figure 20:
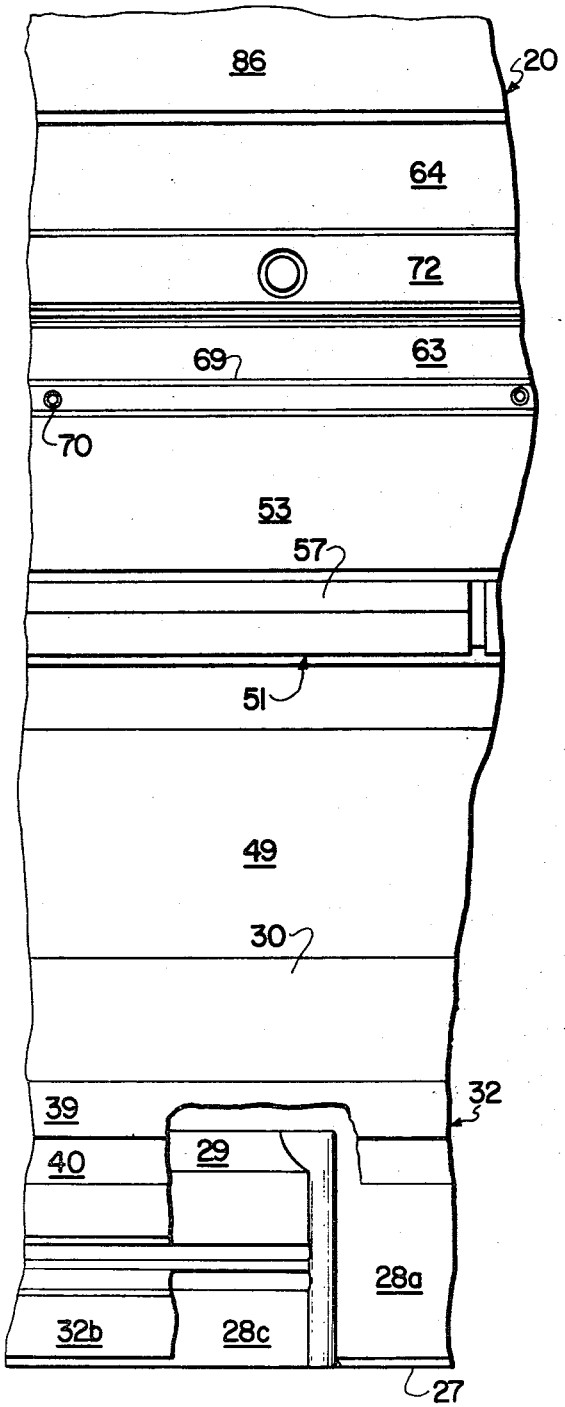
FIG. 20 is a fragmentary side elevational view of a portion of the structure seen in FIG. 19.
Figure 19:
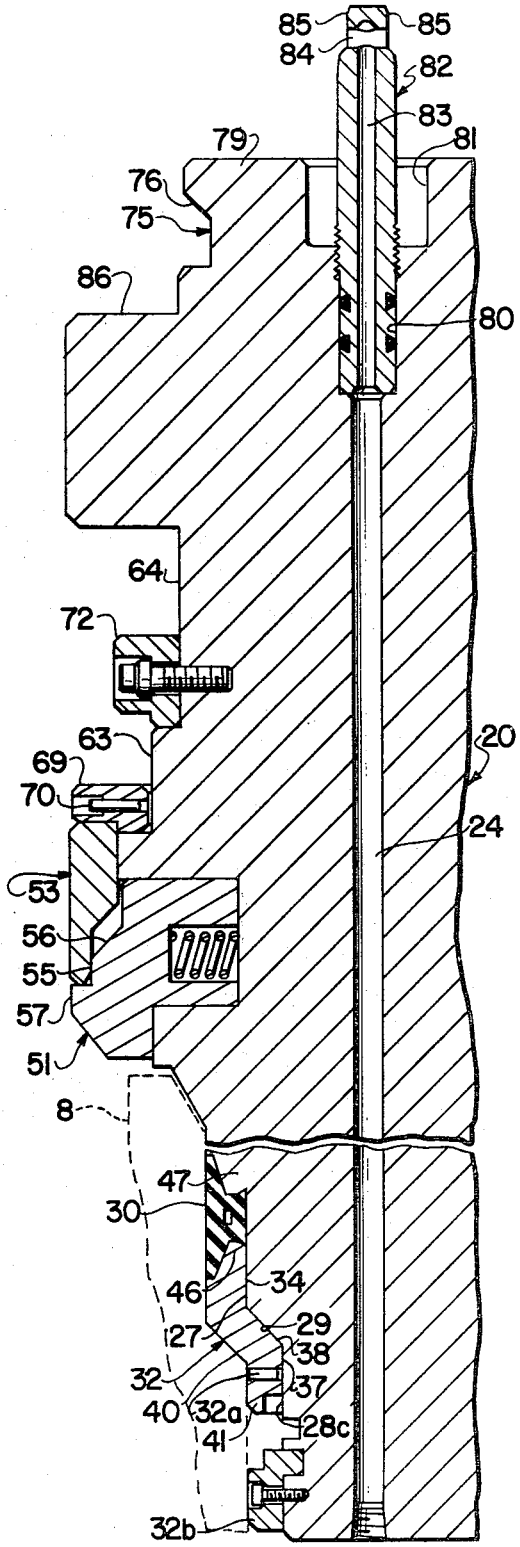
FIG. 19 is a fragmentary sectional view taken generally on line 19—19, FIG. 17.
Figure 21:
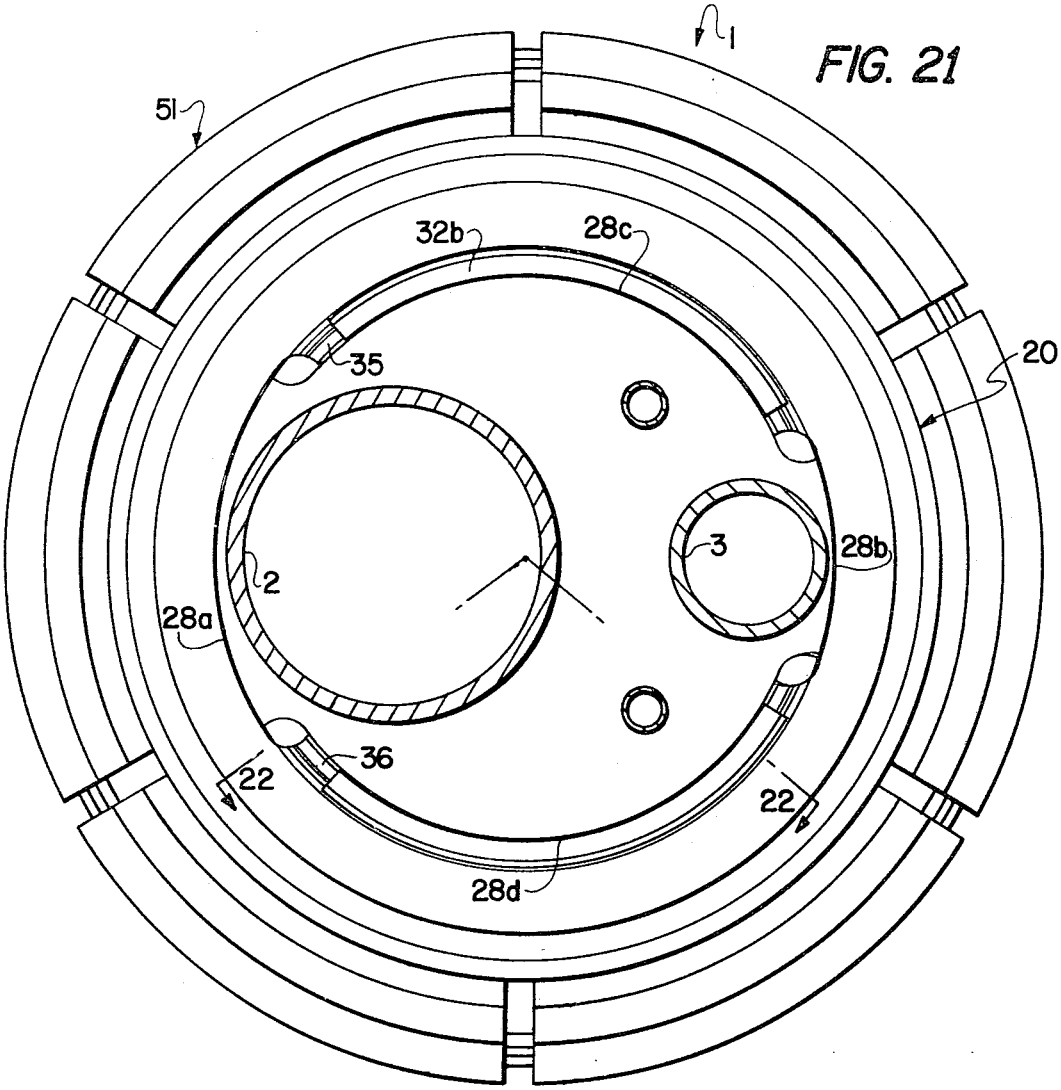
FIG. 21 is a transverse sectional view taken generally on line 21—21, FIG. 18.
Figure 22:
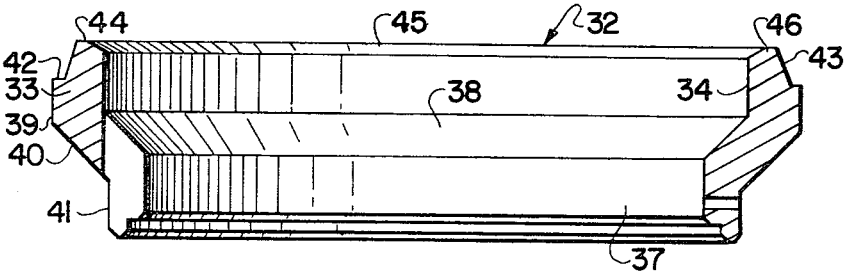
FIG. 22 is a vertical sectional view of one element of the structure seen in FIGS. 17–21, the view being taken generally on line 22—22, FIG. 21.

As will be clear from a comparison of FIGS. 18–22, the lower end portion of hanger body 20 includes a right cylindrical outer surface portion 28 which extends downwardly to bottom end face 27 to present the chordally opposed arcuate portions 28*a* and 28*b*, FIGS. 18 and 21, but is interrupted therebetween to provide arcuate portions 28*c* and 28*d* which are of a smaller diameter than portions 28*a* and 28*b*. At their upper ends, smaller diameter portions join arcuate shoulders 29, one of which is seen in FIG. 19 and the other in FIG. 20. Shoulders 29 lie in a common frustoconical surface which is transverse to the hanger body and tapers downwardly and inwardly at the same angle as the support shoulder 9 presented by packoff device 8. Above shoulders 29, surface portion 27 is surrounded by the elastomeric seal ring 30 of a seal device 31 of the general type described in detail in U.S. Pat. No. 3,268,241, issued Aug. 23, 1966, to Castor et al. Seal device 31 includes an energizing ring 32 which is located below ring 30 and includes an upper portion 33, FIG. 22, having a right cylindrical inner surface 34 slidably embracing surface portion 27 above shoulders 29. The energizing ring further includes two dependent arcuate portions 35 and 36, FIG. 21, portions 35, 36 being of equal arcuate extent and dimensioned to be respectively accommodated by the spaces afforded by the smaller diameter surface portions 28*b*, 28*c*. Portions 35 and 36 have inner surfaces, as at 37, FIG. 22, which are portions of a common right cylindrical surface of a diameter such that inner surfaces 37 slidably embrace surface portions 28*b*, 28*c* of hanger body 20. Inner surfaces 37 and inner surface 34 are joined by upwardly facing shoulders 38 which are part of a common frustoconical surface tapering downwardly and inwardly at the same angle as do shoulders 29 so that energizing ring 32 can be moved upwardly relative to body 20 to bring shoulders 38 respectively into flush engagement with shoulders 29.

Upper portion 33 of ring 32 has a right cylindrical outer surface portion 39 which, at its lower end, joins a downwardly and inwardly tapering frustoconical shoulder 40 which tapers at the same angle as does shoulder 9 of packoff device 8. The lower end of shoulder 40 joins the smaller diameter right cylindrical outer surface portions 41 of dependent portions 35, 36. At its upper end, surface 39 joins a flat transverse annular shoulder 42 which in turn joins an upwardly and inwardly tapering frustoconical surface 43. Surface 43 terminates in a flat transverse annular surface 44 which is joined to inner surface 34 by frustoconical surface 45. Surfaces 43–45 combine to define the upwardly directed annular nose portion 46 of ring 32 which is dimensioned to engage the lower side of elastomeric seal ring 30. At the upper end of surface portions 27 of body 20 the body has a similar but downwardly directed annular nose portion 47 dimensioned to engage the upper side of seal ring 30. Ring 32 is initially retained in the lower position, FIG. 18, by shear pins 32*a* engaged in an outwardly opening groove in body 20. Arcuate retainers 32*b* are secured to body 20 below ring 32, as shown.

Above seal device 31, hanger body 20 presents an outer surface portion 49, FIG. 18, of a diameter sufficiently smaller than that of bore 5 to accommodate the upper end portion of packoff device 8. Above surface portion 49, body 20 is enlarged and has a transverse annular outwardly opening groove 50 which slidably accommodates a plurality of arcuate latch segments 51 arranged in an annular series, each segment being biased outwardly by a plurality of springs 52 so that the segments are each movable radially between a retracted inner position, seen in FIG. 19, an outer latching position, seen in FIGS. 11B and 18, determined by the segment retracting sleeve indicated generally at 53. The outer surface of each segment 51 comprises an upper right cylindrical portion 54 of smaller diameter, a right cylindrical portion 55 of a diameter equal to the diameter of bore 5, a frustoconical camming surface 56 which joins portions 54 and 55 and is upwardly directed, a right cylindrical portion 57, and a flat arcuate upwardly directed portion 58 lying in a plane at right angles to the axis of the annular series of segments. Segments 51 coact with a transverse annular inwardly opening groove 59, FIG. 1A, in the wall of bore 5, surface portion 57 being of a diameter substantially equal to that of the bottom wall 60 of groove 59. Groove 59 has an upper side wall 61 which constitutes a flat annular shoulder at right angles to the axis of bore 5 and so dimensioned that surface portions 58 of the segments can be engaged beneath wall 61 when the tubing hanger has been fully landed and the segments have been moved to their outer positions to engage in groove 59. Segments 51 and groove 59 thus coact to secure tubing hanger 1 with shoulders 40 and 9 engaged, shoulders 29 and 38 engaged, and seal device 31 energized.

Above groove 50, body 20 presents a first right cylindrical surface portion 62 having a diameter substantially smaller than that of bore 5, a second right cylindrical surface portion 63 of smaller diameter, and a third right cylindrical surface portion 64 of still smaller diameter. Segment retracting sleeve 53 comprises a lower portion 65 having an inner diameter substantially equal to that of outer surface portions 55 of segments 51, and an upper portion 66 having an inner diameter substantially equal to that of outer surface portion 62 of body 20. The lower end of portion 65 of sleeve 53 includes a frustoconical end surface 67 dimensioned for flush engagement with the camming surfaces 56 of segments 51. Sleeve 43 is a continuous circular piece installed by passing the sleeve over the lower portion of body 20. Once installed, sleeve 53 is secured at its upper end, as by screws 68, to a flat ring 69 which has an inner diameter such as to slidably embrace outer surface portion 63 of body 20. Ring 69 is made up of two separate semicircular halves and is equipped with radially extending shear pins 70 engaged in upwardly opening notches 71 in body 20 to retain sleeve 53 initially in an upper position in which the inner surface of lower portion 65 embraces surfaces 54 of the segments and end surface 67 is spaced above camming faces 56. When the combination of sleeve 53 and ring 69 is driven downwardly relative to body 20, to the position in FIG. 19, surface 67 engages camming faces 56 to cam all of the segments 51 radially inwardly to their fully retracted position. With the segments in fully retracted position, the segments are fully disengaged from groove 59 and tubing hanger 1 can be withdrawn upwardly.

It will be noted that the upper and lower side walls of groove 50 are flat walls without provision of a retaining lip to restrain segments 51 to an outer position, the outer position for each segment being established by engagement of outer surface portion 54 of the segment with the inner surface of lower portion 65 of retracting sleeve 53 when sleeve 53 is in its upper, inactive position determined by engagement of shear pins 70 in notches 71. To assure that the combination of retracting sleeve 53 and ring 69 cannot shift upwardly relative to body 20 to such an extent that sleeve 53 will disengage from segments 51, two arcuate stop members 72, FIGS. 18 and 19, are secured to body 20 immediately above the shoulder which joins surface portions 63 and 64. Members 72 directly embrace surface portion 64 and are of such radial dimension as to overlap ring 69.

Immediately adjacent its upper end, body 20 has a transverse annular outwardly opening coupling groove 75 defined by a frustoconical downwardly and inwardly tapering upper side wall or shoulder 76, a right cylindrical bottom wall 77 and a flat transverse annular lower side wall 78. The upper end of body 20 presents a flat transverse annular end face 79 lying in a plane at right angles to the central axis of the tubing hanger. Adjacent end face 79, bores 21 and 22 are enlarged at 21*a* and 22*a*, respectively, to provide receptacles opening upwardly through end face 79. Similarly, as illustrated in FIG. 19, each bore 23, 24 is enlarged adjacent to end face 79 to provide an intermediate portion 80, which is larger in diameter than the main portion of the through bore and is threaded adjacent its upper end, and a cylindrical socket 81 which opens upwardly through end face 79. Threadedly engaged in each portion 80 is a stinger, indicated generally at 82, FIG. 19, having an axial bore 83 which opens through the bottom end of the stinger to communicate with the respective bore 23, 24 and, at the upper end of the stinger, opens into a cross bore 84. The upper end portion of each stinger 82 includes two diametrically opposed flat side surfaces 85, through which cross bore 84 opens, and below bore 84 presents a right cylindrical outer surface portion 85 extending over a considerable length of the stinger and projecting above end face 79.

Figure 17:
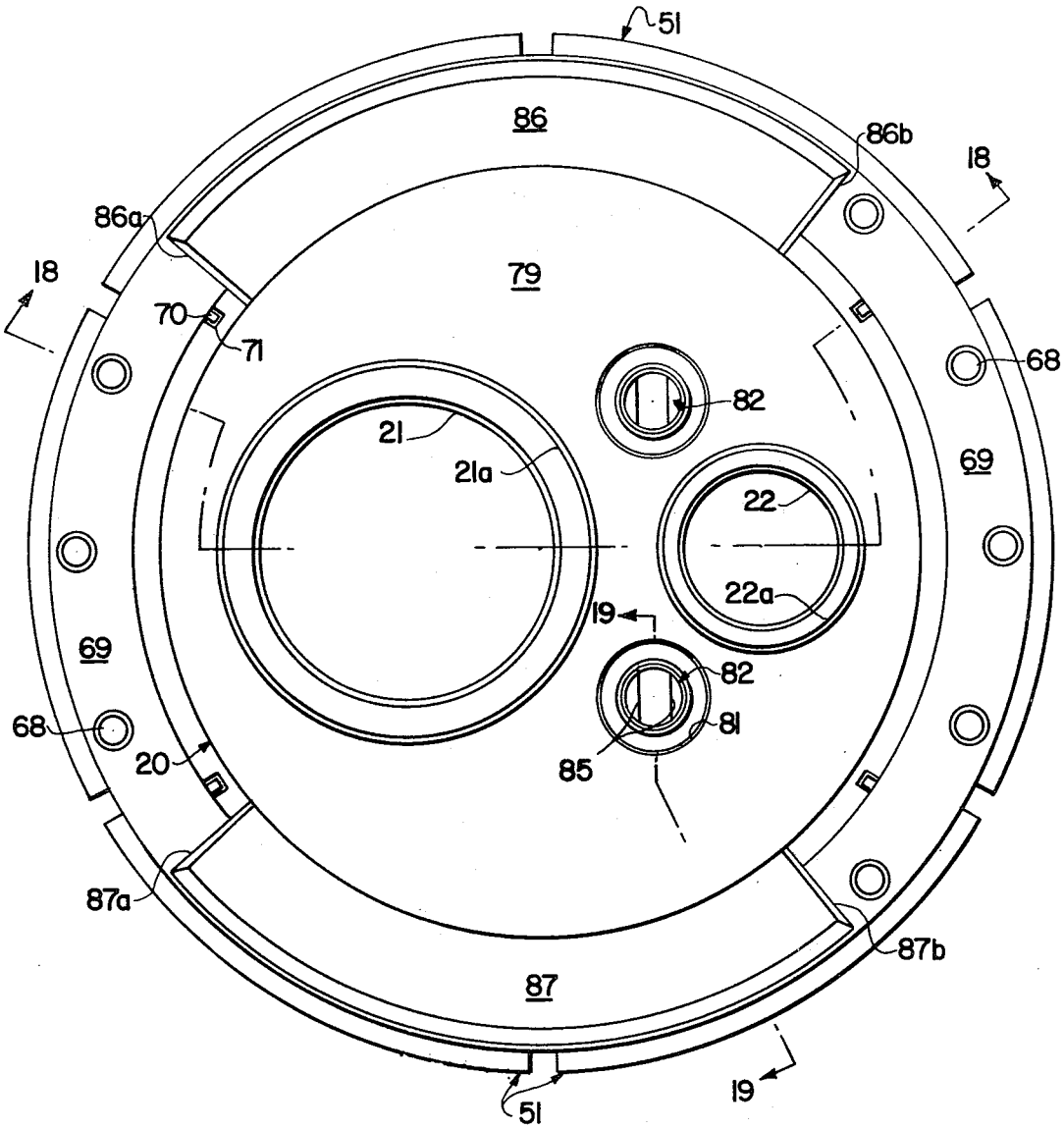
FIG. 17 is a top plan elevational view of a tubing hanger forming part of the apparatus of FIGS. 1–1B.

Immediately below coupling groove 75, body 20 is formed with a heavy transverse annular outwardly projecting flange which is cut away to provide two chordally opposed flange portions 86 and 87, FIGS. 1A, 17 and 18. Stop members 72 are each axially aligned below a different one of flange portions 86, 87 so that, in the arcuate areas between the two flange portions, ring 69 is upwardly exposed in the manner seen in FIG. 17. Flange portions 86, 87 are of equal arcuate extent but, being opposed along a chord of the circular transverse cross section of body 20 rather than along a diameter, leave two arcuate gaps of different size. Thus, in a typical tubing hanger, the arcuate gap between end face 86*a* of flange portion 86 and end face 87*a* flange portion 87 may extend for 80° while the gap between end faces 86*b* and 87*b* extends for 100°. Considering FIG. 17, it will be apparent that the upwardly opening receptacles 21*a* and 22*a* and the stingers 82 occupy predetermined positions relative to the arcuate gaps between flange portions 86, 87 so that, if the rotational positions of flange portions 86, 87 are known, the positions of receptacles 21*a* and 21*b* and stingers 82 are also known.

Handling Tool 13

The handling tool comprises a body, indicated generally at 90, comprising an upper tubular mamber 91 and a lower tubular member 92. Member 91 presents throughout most of its length a right cylindrical outer surface 93 of a diameter substantially smaller than that of bore 11 of upper body 10. The lower end portion of member 91 is thickened so as to present an outer surface portion 94, FIG. 11A, embraced by the upper end portion of member 92. Members 91 and 92 are secured together by the combination of a fastening ring 95 and a torque key 96 in the manner described in detail in my aforementioned application Ser. No. 120,046 so that all axial loads applied in tension to lower member 92 are transferred to upper member 93 via ring 95 and rotational loads are transferred between members 91 and 92 via torque key 96.

Figure 11:
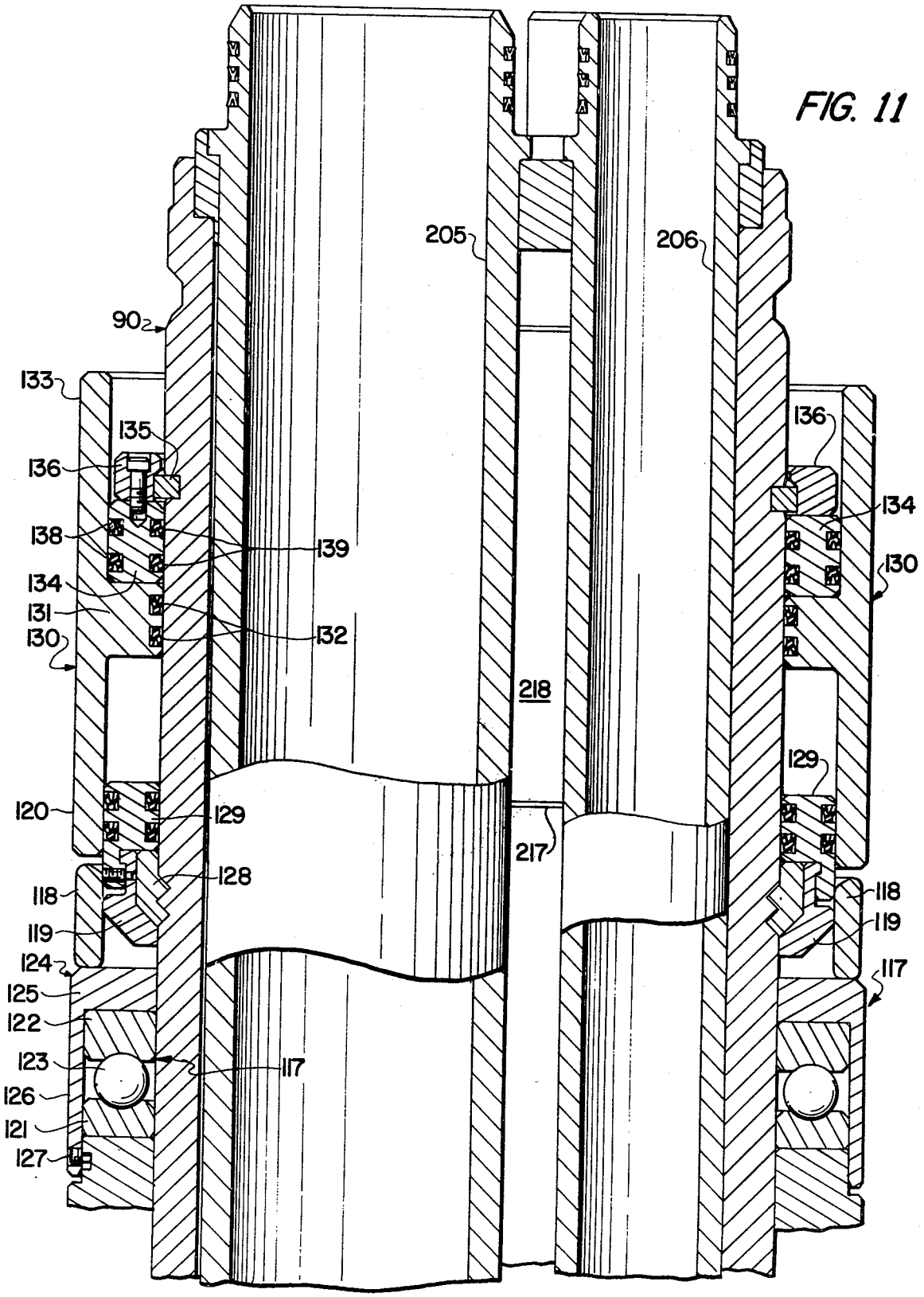
FIGS. 11–11B are vertical cross-sectional views, enlarged with respect to FIGS. 1–1B, which combine to illustrate a handling tool and tubing hanger forming part of the apparatus shown in FIGS. 1–1B, FIG. 11 being taken generally on line 11—11, FIG. 3, FIG. 11A being taken generally on line 11A—11A, FIG. 4, and FIG. 11B being taken generaly on line 11B—11B, FIG. 8.
Figure 11A:
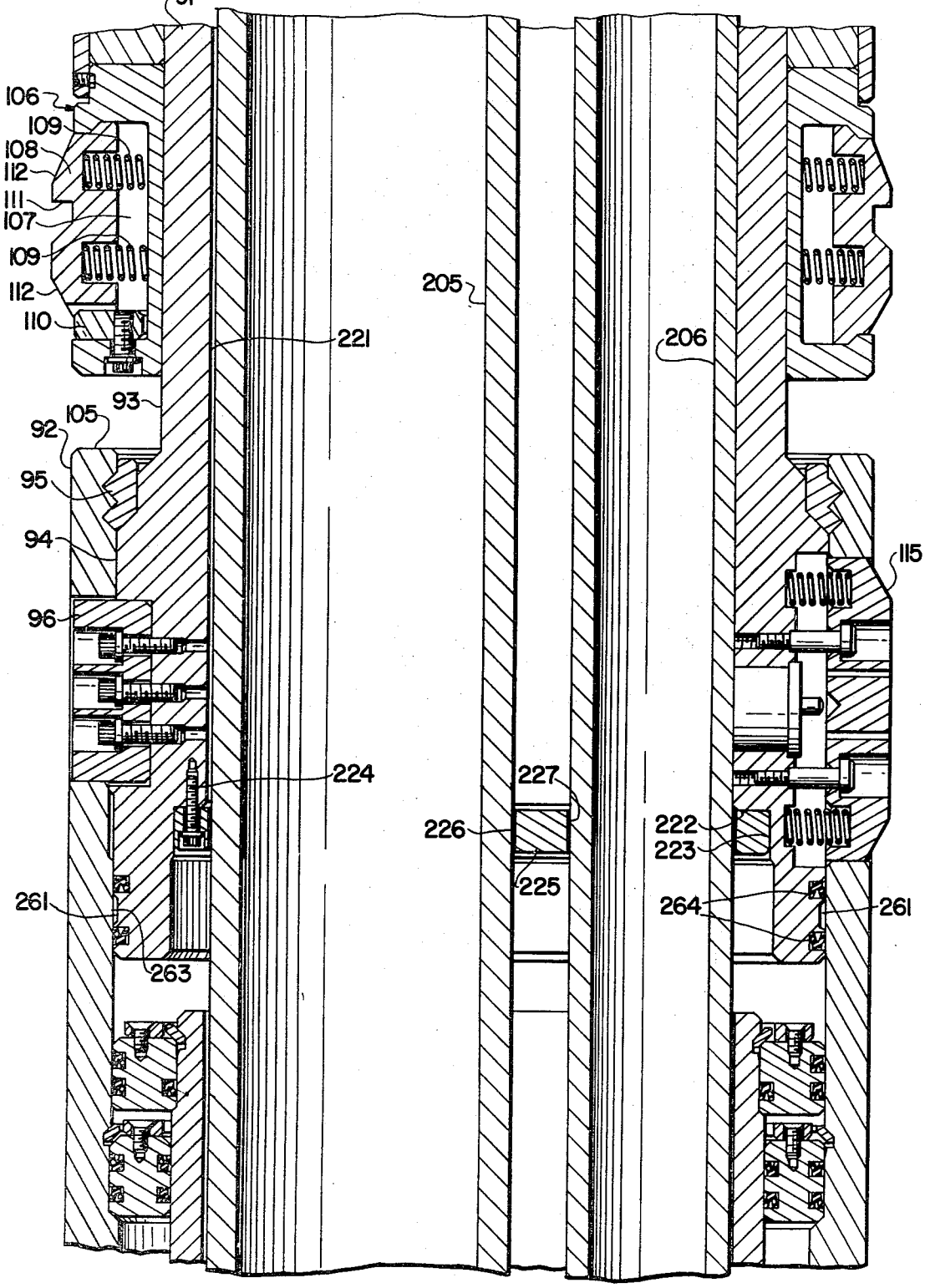
Figure 11B:
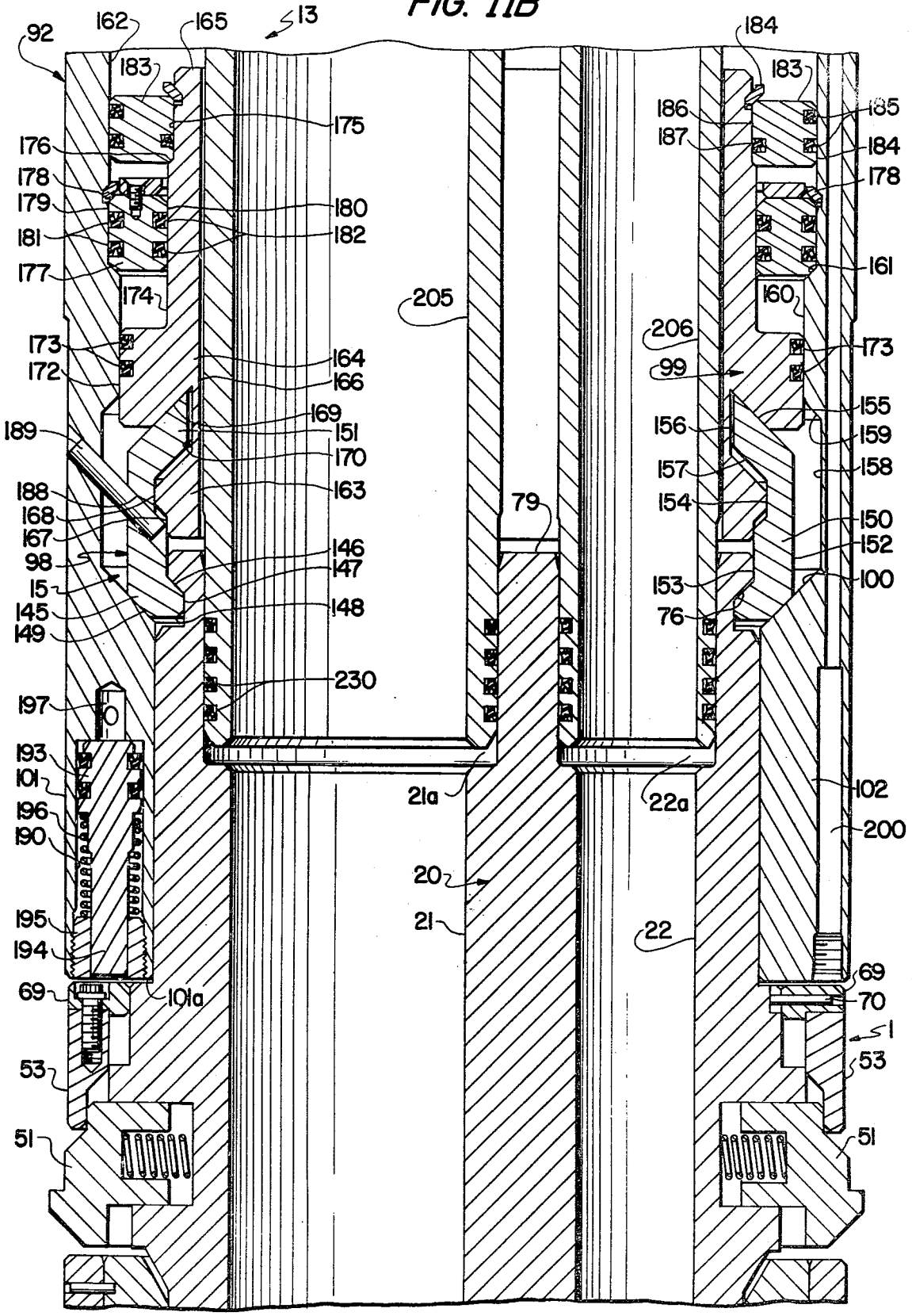

The coupling 15 employed to secure tubing hanger 1 to handling tool 13 comprises a plurality of arcuate coupling segments 98, an actuating piston indicated generally at 99, a frustoconical downwardly and inwardly tapering load-bearing shoulder 100 presented by the lower end portion of member 92, and the upper side wall 76 of groove 75 in hanger body 20. As seen in FIG. 1A, member 92 comprises two dependent splines 101 and 102 which are integral with member 92 and constitute extensions of the tubular wall of that member. Splines 101, 102 are spaced diametrically relative to member 92. Spline 101 is dimensioned to be slidably accommodated in the gap defined by end faces 86*a* and 87*a* of flange portions 86 and 87, respectively, of the tubing hanger. Spline 102 is dimensioned to be slidably accommodated in the larger gap defined by end faces 86*b* and 87*b*. Accordingly, when the tubing hanger is attached to the handling tool, the attachment can be made only when spline 101 is engaged between end faces 86*a* and 87*a* and spline 102 is engaged between end faces 86*b* and 87*b*, and all points on end face 79 of the tubing hanger therefore occupy predetermined rotational positions relative to handling tool 13. When the tubing hanger has been attached to the handling tool, the inner faces of splines 101, 102 slidably embrace outer surface portion 64 of the tubing hanger. End faces 101*a* and 102*a* of the splines, which lie in a common plane transverse to the handling tool body, are then parallel to and immediately adjacent to the upper face of ring 69, as seen in FIG. 11B.

The upper end of member 92 presents a transverse annular upwardly directed end face 105. Above end face 105, a support ring or collar 106 slidably embraces outer surface 93 of upper body member 91. As seen in FIG. 11A, ring 106 has a transverse annular outwardly opening groove 107 in which a plurality of support segments 108 are disposed in an annular series, each segment 108 being biased radially outwardly by springs 109 to outer positions determined by retaining lips on the upper and lower side walls of the groove. As is well known in the art, the retaining lips are gapped to allow the segments to be installed and the series of segments is restrained as by key 110, FIG. 11A, to a rotational position in which the retaining lips are effective to limit outward motion of all of the segments. Each segment 108 comprises a downwardly facing support shoulder 111 and camming shoulders 112. Bore 11 of upper body 10 is provided with a transverse annular inwardly opening groove 113 the radial cross section of which matches that of segments 108, so that groove 113 presents an upwardly facing shoulder 114 on which the support shoulders 111 of the segments can seat with flush engagement.

The telescopically overlapping portions of members 91, 92 carry a locator key 115 to coact with orientation reference slot 12 in upper body 10 when the handling tool body 90 has been lowered into bore 11 and rotated to the proper position. Key 115 can be constructed as disclosed in application Ser. No. 36,659, filed May 7, 1979, by Michael L. Wilson, and is biased outwardly by springs 103.

According to the invention, once segments 108 have been engaged in groove 113, the entire weight of tubing strings 2 and 3, tubing hanger 1 and handling tool 13 is rotatably supported on ring 106 by releasable means comprising the antifriction thrust bearing indicated generally at 117, a thrust ring 118, a camming ring 119 and a restraining sleeve 120. Bearing 117 comprises a lower race member 121 seated on the upper end face of ring 106, an upper race member 122, bearing balls 123 engaged between the two race members, and a retainer 124 comprising a relatively thick flat annular member 125 superimposed on upper race member 122 and from which a tubular outer skirt 126 depends to enclose the race members, the lower end of the skirt surrounding an upper portion of ring 106 and being secured thereto, as by screws 127.

Camming ring 110 is rigidly secured to upper body member 91 by the combination of a split ring fastener 128 and sealing ring 129 in the manner described in detail in aforementioned copending application Ser. No. 120,046. The camming ring has a frustoconical downwardly and inwardly tapering camming face 130. Thrust ring 118 is a split ring so dimensioned that when ring 118 is embraced by restraining sleeve 120 the upper end of the ring 118 is disposed to engage camming face 130 so that the thrust ring is trapped between the inner face of sleeve 120 and camming face 130. Hence, the downward load of the tubing strings applied to body member 91 is transferred to bearing 117, and thence to ring 106, via fastener ring 128, camming ring 119 and thrust ring 118, when the parts are in the relative positions seen in FIG. 12, with sleeve 120 embracing thrust ring 118.

Restraining sleeve 120 forms part of an annular piston 130 having a central hub 131 which slidably embraces outer surface 94 of body member 91 and is equipped with seal rings 132 to form a fluid-tight seal between hub 131 and surface 94. Sleeve 120 is integral with hub 131 and depends therefrom. Also integral with the hub is an upwardly projecting sleeve 133 of the same diameter and wall thickness as sleeve 120 and coaxial therewith, the outer surfaces of the two sleeves and the hub being coplanar. Spaced above hub 131 is a second seal ring 134 which is rigidly secured to body member 91 by the combination of snap ring 135, retaining ring 136 and screws 137, the snap ring being engaged in a groove in body member 91 as shown. Ring 134 is slidably embraced by sleeve 133 and is provided with elastomeric seal rings 138, forming a fluid-tight seal between ring 134 and sleeve 133, and elastomeric seal rings 139 forming a fluid-tight seal between ring 134 and surface 94. Ring 129 is similarly provided with elastomeric seal rings to seal between ring 129 and surface 94 and between ring 129 and sleeve 120. Hub 131 is slidable on body 91 over the distance between rings 129 and 134. As later described, provision is made for supply of pressure fluid selectively to the space between ring 134 and hub 131, to drive piston 130 downwardly so that sleeve 120 embraces ring 118 as seen in FIG. 12, or to the space between hub 131 and ring 129, to drive piston 99 upwardly so that thrust ring 118 is no longer embraced by sleeve 120, as seen in FIG. 11.

Figure 12:
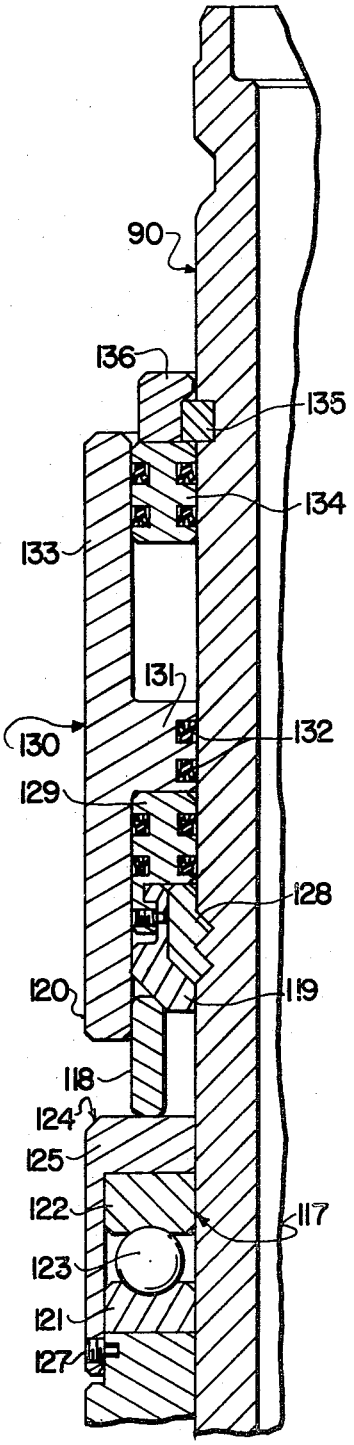
FIG. 12 is a fragmentary vertical cross-sectional view similar to FIG. 11 but showing parts in the relative positions which exist before orienting and landing the tubing hanger.

When the handling tool is attached to the tubing hanger at the operational base preparatory to running in and landing the tubing hanger, piston 130 is moved to the position seen in FIG. 12 so that, before the tubing hanger reaches support shoulder 9, segments 108 latch into groove 113 and the entire weight of the tubing strings, tubing hanger and handling tool is applied to support ring 106 via thrust ring 118 and bearing 117. Since the tubing hanger has not yet come into engagement with shoulder 9, the combination of the handling tool, tubing hanger and tubing strings is free to be rotated on bearing 117, by manipulation of the handling string, until locator key 115 comes into engagement with orientation reference slot 12. When that occurs, pressure fluid is supplied between hub 131 and ring 129, driving piston 130 upwardly to the position seen in FIG. 11 so that thrust ring 118 is released and the weight of the tubing strings forces camming ring 119 downwardly, ring 118 thus being expanded so that the camming ring moves downwardly through the thrust ring. The dimensions of the handling tool and tubing hanger are such, relative to the effective axial distance between shoulders 9 and 114, that the additional downward movement of the tubing hanger required to land shoulder 40 of the tubing hanger on shoulder 9 does not bring camming ring 119 into engagement with bearing retainer 124. Thus, FIG. 11 shows the relative positions of ring 119 and retainer 124 after the tubing hanger has been landed.

Referring to FIG. 11B, it will be seen that segments 98 of coupling 15 are of generally C-shaped radial cross section and each comprises a lower portion 145 defined by an upper frustoconical face 146, a right cylindrical inner face 147, a lower face portion 148 which is flat and at right angles to the axis of the coupling, and a lower frustoconical face portion 149, face portion 149 and face 146 tapering downwardly and inwardly at the same angle as does the upper side wall 76 of tubing hanger groove 75 and shoulder 100 of handling tool body member 13. Segments 98 further comprise an intermediate portion 150 and an upper portion 151. Portion 150 is defined by a right cylindrical outer surface 152, a smaller diameter right cylindrical inner surface portion 153 and an inner surface portion 154 which is of larger diameter than portion 153, surfaces 152–154 being concentric. Upper portion 151 is defined by a frustoconical upper face 155, a right cylindrical inner face 156 and a frustoconical lower face 157, faces 155 and 157 tapering upwardly and inwardly at the same angle. The portion of body member 92 immediately above splines 101, 102 has a transverse annular inwardly opening recess which conforms generally to the outer configuration of segments 98 and is defined by shoulder 100, an intermediate right cylindrical surface 158 and a frustoconical surface 159 which tapers upwardly and inwardly at the same angle as surfaces 155. Shoulder 100 is of substantially greater radial extent than segment faces 149 and surface 158 is slightly longer than segment surfaces 152.

Above surface 159, body member 92 has a relatively short right cylindrical surface 160 of a diameter significantly larger than the inner diameter of shoulder 100. Surface 160 terminates at its upper end at a small downwardly and inwardly tapering frustoconical shoulder 161. A right cylindrical surface 162 extends upwardly from shoulder 161. Actuating piston 99 has a lower portion 163, an intermediate transverse annular outwardly projecting hub 164 and an upper portion 165, portions 163 presenting a common inner surface 166. Lower portion 163 has a lower right cylindrical outer surface 167 equal in diameter to the outer surface portion **64*a* of tubing hanger body 1 between groove 75 and end face 79. Portion 163 also has a larger diameter right cylindrical outer surface portion 168 of a diameter only slightly smaller than that of the segment surfaces 154. Above surface portion 168, the piston is formed with a transverse annular downwardly and outwardly opening groove dimensioned to freely accommodate upper end portions 151 of segments 98 and defined by a frustoconical upper wall 169, a right cylindrical inner wall 170 and a frustoconical lower wall 171, walls 169, 171 tapering upwardly and inwardly at the same angle as segment faces 155, 157. Hub 164 has flat annular top and bottom surfaces and a right cylindrical outer surface 172, the diameter of surface 172 being slightly smaller than that of surface 160. Surface 192 is grooved to accommodate elastomeric sealing rings 173 which establish a fluid-tight seal between hub 164 and inner surface 160 of body 92. Upper portion 165 of the piston has a lower right cylindrical outer surface portion 174 and an upper right cylindrical outer surface portion 195, portions 174, 175 being joined by a transverse annular upwardly directed shoulder 176**.

A first seal ring 177 is secured to member 92 between a split ring fastener 178 and shoulder 161 in the manner described in my copending application Ser. No. 120,045. Ring 177 has right cylindrical outer and inner faces 179 and 180, respectively. Face 179 is of slightly smaller diameter than surface 162 and is grooved to accommodate elastomeric sealing rings 181 which establish a fluid-tight seal between the ring and member 92. Face 180 is of slightly larger diameter than piston surface 174 and is grooved to accommodate sealing rings 182 which establish a seal between the ring and the piston. Above ring 177, a second seal ring 183 is similarly secured to upper portion 165 of the piston by split ring fastener 184 and shoulder 176. Ring 183 has a right cylindrical outer surface 184 which is of slightly smaller diameter than surface 162 and carries sealing rings 185 to seal between the ring and member 92. The right cylindrical inner surface 186 of ring 183 is slightly larger in diameter than is surface 175 and carries a sealing ring 187 which forms a fluid-tight seal between the ring and upper portion 165 of the piston. As later described, provision is made for selective supply of pressure fluid to the space between hub 164 and ring 177, to drive piston 99 downwardly relative to member 92, and to the space between rings 177, 183 to drive the piston upwardly relative to member 92.

Each segment 98 has a guide bore 188 which extends through intermediate portion 150, slanting downwardly and inwardly at the same angle as do faces 146, 149, bore 188 being of circular transverse cross section. For each segment 98, a cylindrical pin 189 is secured rigidly to member 92 so as to project downwardly and inwardly at the same angle as bore 188. Pins 189 project almost to the location of outer surface 167 of piston 99 and each pin is slidably received in a different one of the bores 188. When piston 99 occupies its uppermost position relative to member 92 as seen in FIG. 16, segments 98 are constrained to their outermost position, with segment surfaces 152 adjacent surface 158 and with segment surfaces 147 spaced outwardly sufficiently to allow surface portion 64*a* of the tubing hanger body to pass the segments.

When, by manual operations carried out at the surface of the body of water, the handling tool is moved downwardly onto the tubing hanger until the lower ends of splines 101, 102 engage ring 69 (then in its upper position), the space between upper wall 76 of tubing hanger groove 75 and shoulder 100 is slightlly larger than the space between faces 146 and 149 of segments 98. At this time, the entire weight of the tubing strings and hanger are supported from apparatus on the vessel or other operational base and there is as yet no load-bearing connection between the tubing hanger and the handling tool. Pressure fluid is now supplied to the annular space between ring 177 and hub 164, so that piston 99 is forced downwardly relative to the handling tool. As the piston moves downwardly, downward movement of segments 98 is impeded by interengagement of surfaces 149 and shoulder 100 and by engagement of pins 189 in bores 188, and the segments are cammed inwardly as they are moved downwardly. Engagement of piston face 169 with segment faces 155 aids this camming action. As a result, lower portions 150 of the segments move in directions parallel to shoulder 149 and wall 76 and enter the space between the shoulder and wall, segment faces 147 coming into contact with the bottom wall 77 of tubing hanger groove 75 to stop downward movement of the piston and segments. Support of the tubing strings is now shifted from the tubing hanger to the handling tool, so that the tubing hanger moves downwardly slightly relative to the handling tool to cause the total weight of the tubing strings to be transferred to handling 13 via surfaces 76, 146, 149 and 100, with the lower portions of the segments being essentially in compression between shoulders 76 and 100.

Figure 16:
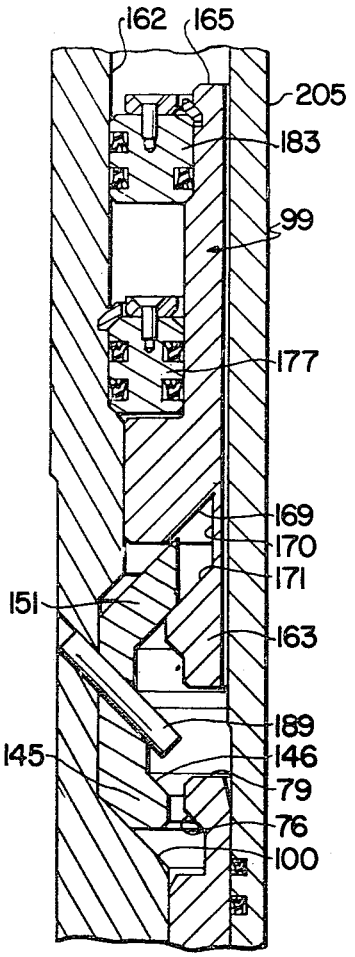
FIG. 16 is a fragmentary vertical cross-sectional view similar to FIG. 11B but showing parts of the coupling in different relative positions.
Figure 2:
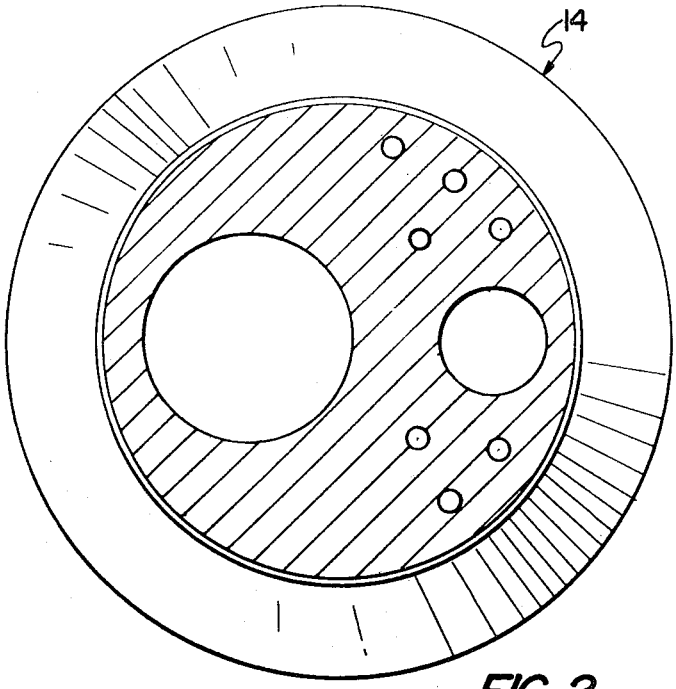
FIGS. 2–4 are transverse cross-sectional views taken generally on lines 2—2, 3—3 and 4—4, FIG. 1, respectively.
Figure 3:
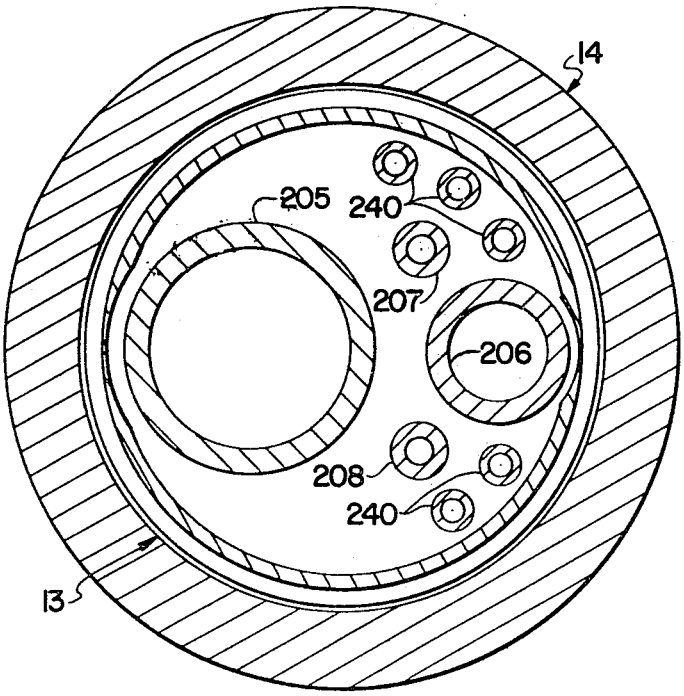

When the tubing hanger 1 has been landed on shoulder 9 and it is desired to detach handling tool 13 from the tubing hanger, pressure fluid is supplied to the space between rings 177 and 183 and exhausted from the space between piston hub 164 and ring 177 so that piston 99 is driven upwardly to the position seen in FIG. 16. Since the load of the tubing strings is now carried by shoulder 9, the compression force acting on the lower portions of segments 98 is now minimal. As upward movement of piston 99 commences, faces 100 and 146 coact and faces 157 and 171 coact to cam the segments upwardly and outwardly, returning the segments to the outer, inactive position seen in FIG. 16.

From the foregoing, it will be apparent that when the weight of the handling tool, tubing hanger and tubing strings is supported on bearing 117 via thrust ring 118, latch segments 51 of the tubing hanger are still above groove 59 and therefore occupy their retracted positions because surfaces 57 of the segments engage the wall of bore 5. But, as the tubing hanger is landed on shoulder 9, segments 51 snap outwardly to engage in groove 59 and the tubing hanger is thus latched against upward movement relative to body 4. Handling tool 13 can be operated to retract segments 51 and free the tubing hanger for retrieval. For this purpose, splines 101, 102 are each provided with four vertical bores 190, FIG. 9, which open downwardly through end walls 101*a*, 102*a* of the splines. Each bore contains a piston 193 from which depends a push rod 194, rods 194 being rigidly secured to the respective piston and extending downwardly each through the central bore of an end member 195. Members 195 are cylindrical pieces, externally threaded, and screwed into the internally threaded lower end portions of the respective bores 190 so that members 195 close and seal the lower ends of bores 190. Each piston 193 is biased upwardly by a compression spring 196 engaged between the piston and the corresponding member 195. A short vertical blind bore 197 projects upwardly from and opens into each bore 190. As seen in FIGS. 8–10 and 11B, lower body member 92 of the handling tool is provided with a long vertical bore 198 centered with respect to spline 101 and extending from a point near the lower end of upper body member 91 downwardly and completely through spline 101, the lower end of bore 198 being closed and sealed by a threaded plug 199, FIG. 9. Member 92 is also provided with a second vertical bore 200, FIGS. 8 and 11B, similar to bore 198 but centered on spline 102. Bores 198 and 200 are thus in diametrically opposed locations and each extends downwardly through the respective spline 101, 102 between the central pair of the bores 190 of the spline. As will be clear from FIGS. 9 and 10, bore 198 communicates with all of the four bores 197 of the spline via cross bores 201 which are drilled conventionally along chords of the circular cross section, the outer inactive ends of the cross bores being conventionally plugged. Bore 200 is similarly connected to the bores 197 of spline 102. As later described, provision is made for the supply of pressure fluid to bores 198, 200 and thus to bores 190 above pistons 193 to drive push rods 194 downwardly.

With tubing hanger 1 in its landed position as seen in FIG. 1B, so that latch segments 51 are engaged in groove 59, segments 51 are retracted, to disengage from groove 59, by supplying pressure fluid through bores 198, 200 to bores 190 and thus drive push rods 194 downwardly against ring 69. Ring 69 carries retracting sleeve 53 downwardly, so that surface 67 of the sleeve engages camming surfaces 56 of segments 51 and cams the segments inwardly to their disengaged positions, see in FIG. 19. Once push rods 194 have driven ring 69 and sleeve 53 downwardly to the positions seen in FIG. 19, the ring and sleeve remain in those positions, and since the sleeve embraces segment surfaces 55, the segments are held in their fully retracted positions until, the tubing hanger having been retrieved, sleeve 53 and ring 69 are returned to the upper positions, seen in FIG. 18, so that shear pins 70 can be replaced to again restrain the ring and sleeve against downward movement relative to hanger body 20. Considering FIG. 19, it will be noted that the outer face of sleeve 53 is coplanar with segment surfaces 57 when segments 51 have been retracted by the sleeve, so that the combination of ring 69, sleeve 53 and the retracted segments 51 offers the least possible chance for interference with surrounding equipment as the tubing hanger is withdrawn upwardly.

Figure 13:
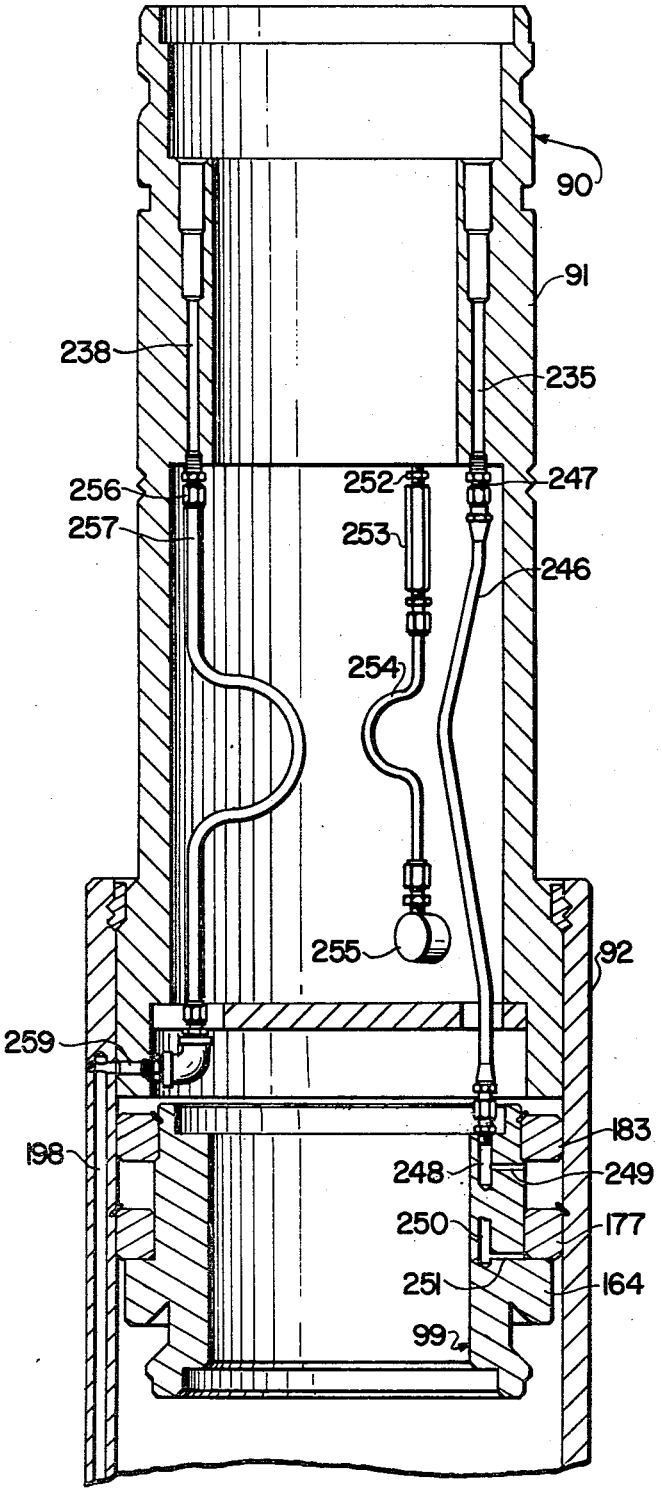
FIG. 13 is a vertical sectional view, reduced relative to FIGS. 11–11B, of a portion of the handling tool illustrating the manner in which hydraulic lines are arranged within the tool.

As best seen in FIG. 13, taken in conjunction with FIGS. 3, 4, 8 and 11–11B, handling tool body 90 supports a tubular stinger 205 to communicate with bore 21 of the tubing hanger, a second tubular stinger 206 to communicate with bore 22 of the tubing hanger, and stingers 207, 208 to communicate with bores 23 and 24, respectively, of the tubing hanger. At its upper end, the inner diameter of body member 91 of the handling tool is enlarged to accommodate an alignment and support collar 209 which is seated on a transverse annular upwardly facing shoulder 210 presented by member 91. Collar 209 has a flat main upper face 211 which lies in a plane at right angles to the longitudinal axis of body 90 and is recessed a short distance below the upper end of the collar so that, as seen in FIG. 11, face 211 is surrounded by an upstanding annular portion 212. Collar 209 has a vertical through bore 213 to accommodate stinger 205, a second vertical bore 214 to accommodate stinger 206, and two additional bores to similarly accommodate stingers 207 and 208. The upper end portion of each stinger is provided with a transverse annular outwardly projecting flange resting upon upper face 211 of the collar. Thus, stinger 205 is provided with shoulder 215. The upper end portion of each of stingers 205–208 projects above collar 209 for a significant distance and is equipped with elastomeric sealing rings, as at 216 for stinger 205, to seal with the wall of a downwardly opening socket (not shown) presented by the composite riser section 14.

Figure 4:
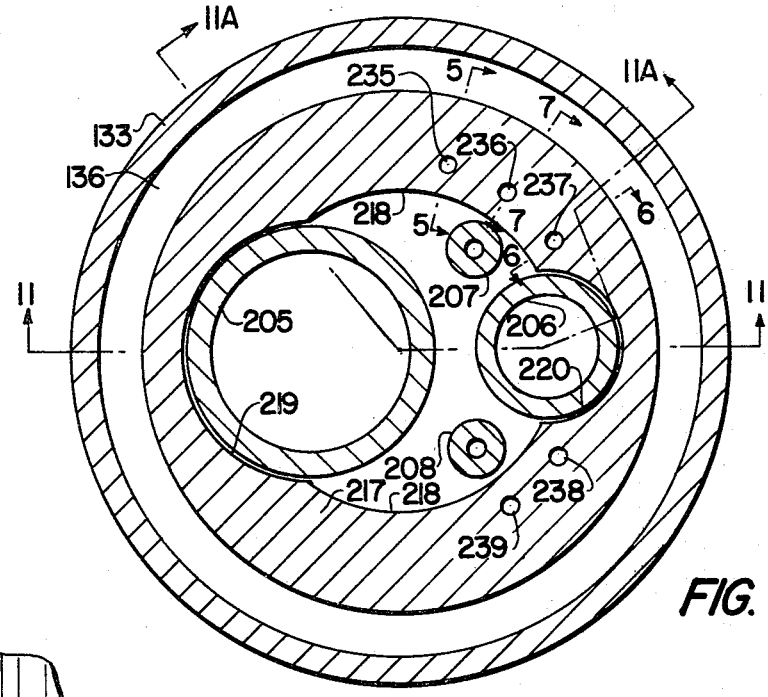
Figure 14:
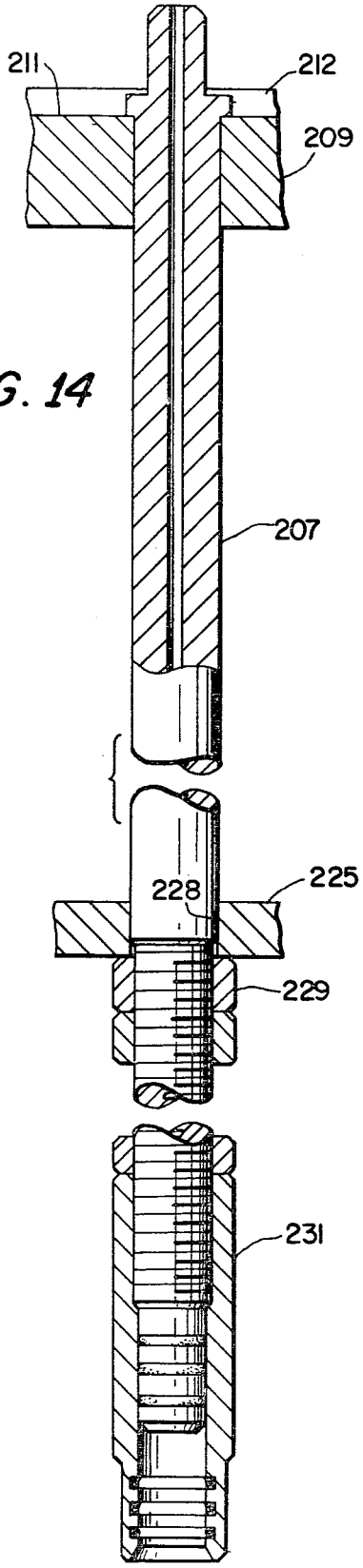
FIGS. 14 and 15 are fragmentary vertical sectional views of structure within the handling tool.
Figure 15:
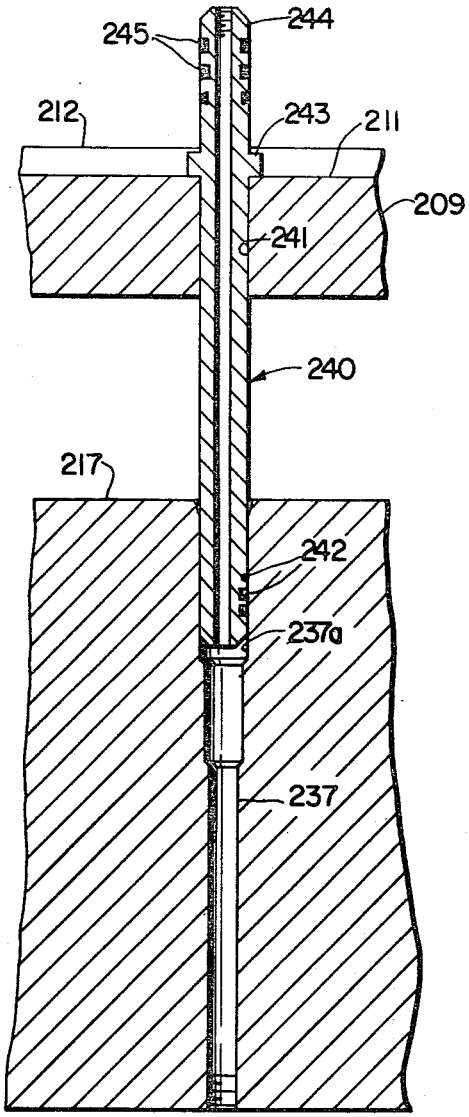

In a location spaced a short distance below shoulder 210, body 91 has an inwardly projecting transverse annular flange 217, FIGS. 4 and 11, which is of substantial axial thickness and, internally, presents right cylindrical surface portions 218 and right cylindrical recesses 219 and 220, FIG. 4, the latter being of a diameter to slidably embrace stingers 205 and 206, respectively. Below flange 217, the inner surface 221 of member 91 is a right cylinder of a diameter significantly larger than that of surface portions 218, surface 221 extending downwardly to a point near the lower end of member 91. At this point, as seen in FIG. 11A, the internal diameter of member 91 is increased to provide a flat transverse annular downwardly facing shoulder 222 and a right cylindrical surface portion 223. Embraced by surface portion 223 and rigidly secured to shoulder 22, as by screws 224, is an alignment plate 225 having openings 226, 227 snugly accommodating stingers 205 and 206, respectively. As seen in FIG. 14, plate 225 has an opening 228 through which stinger 207 extends, this stinger being secured in tension by reason of engagement of its shoulder **207*a* with face 211 of collar 209, on the one hand, and engagement of a nut 229 with the lower face of plate 225, on the other hand, nut 229 being engaged with external threads on the stinger. Stinger 208 similarly extends through an opening (not shown) in plate 225** and is likewise secured in tension.

Below plate 225, stingers 205–208 extend through the interior space defined by annular piston 99, FIG. 11B. The plan shape of inner surface 166 of piston 99 is the same as that shown in FIG. 4 for flange 217 and therefore closely embraces stingers 205, 206 over major portions of the circumferences of those stingers, stingers 207, 208 being spaced slightly inwardly from surface 166. Stingers 205 and 206 project significantly below piston 99, the dimensions being such that lower end portions of the two stingers enter and are accommodated by the receptacles **21*a* and 21*b*, respectively, of tubing hanger 1. The diameters of the lower end portions of stingers 205, 206 are only slightly smaller than the diameters of the respective receptacles, and each stinger is equipped with elastomeric sealing rings 230 to form fluid-tight seals between the stingers and the side walls of the receptacles. At their lower ends, stingers 207 and 208 are each equipped with a female connector member 231, FIG. 14, having an inner diameter such as to slidably accommodate the corresponding upwardly projecting stinger 82 of tubing hanger 1**.

Since the upper end portions of stingers 205–208 are snugly embraced by downwardly opening receptacles presented by riser section 14, and are snugly embraced by collar 209, flange 217, plate 225 and piston 99, and are thus secured in specific positions relative to handling tool 13, and since engagement of splines 101, 102 in the gaps between flange portions 86, 87 of the tubing hanger specifically orients the handling tool relative to the tubing hanger, the lower ends of stingers 205, 206 are substantially coaxial with receptacles **21*a*, 22*a* whenever splines 101, 102 enter the gaps between flange portions 86, 87. To assure precise alignment, stingers 205, 206 are provided with downwardly and inwardly tapered annular lower end guide surfaces 232, FIG. 11B. Similarly, the female connector members 231 of stingers 207, 208 are provided with annular upwardly and inwardly tapering guide surfaces 233, FIG. 14**.

Figure 5:
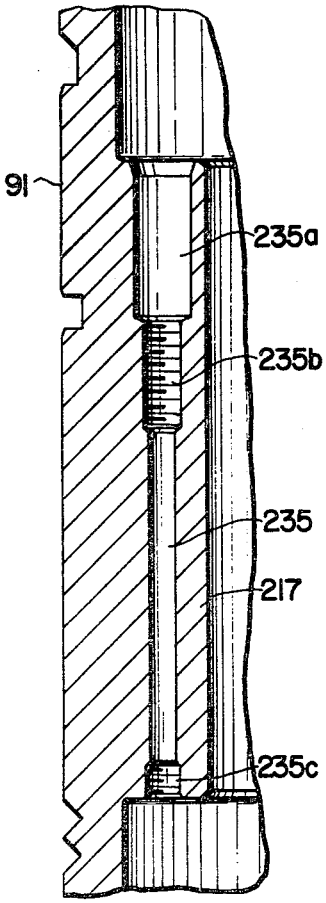
FIGS. 5–7 are fragmentary vertical cross-sectional views taken generally on lines 5—5, 6—6 and 7—7, FIG. 4, respectively, with some parts omitted for clarity of illustration.
Figure 6:
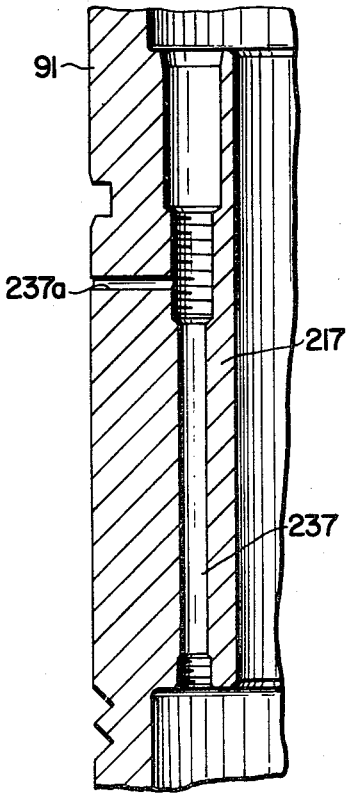
Figure 7:
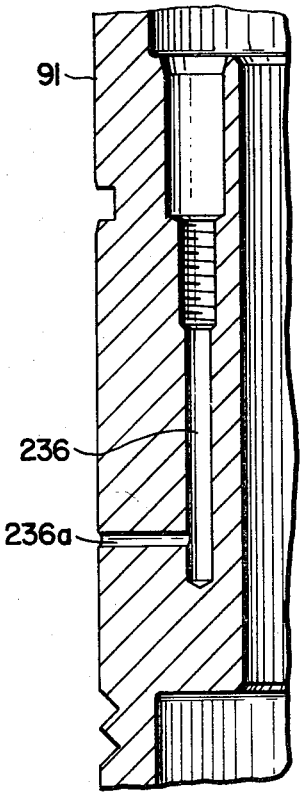

As seen in FIGS. 4–7 and 15, flange 217 is provided with bores 235–239, bores 235, 238 and 239 being through bores in the manner shown by FIG. 5, bore 237 being a through bore with a radial branch 237a, FIG. 6, and bore 236 being a blind bore which opens through the upper face of flange 217 and communicates only with a radial bore **236*a*, FIG. 7. The upper portions of all five bores are identical, including an enlarged top portion 235*a*, FIG. 5, and an intermediate portion 235*b*. The lower end of each through bore is threaded, as at 235*c*, FIG. 5. Each bore 235–239 is equipped in the manner shown in FIG. 15, with a stinger element 240 which extends through an opening 241 in collar 209 and is disposed with its lower end portion within, e.g., the upper portion 237*a* of bore 237, the lower end portion being equipped with elastomeric sealing rings 242 to form a fluid-tight seal between stinger element 240 and the wall of upper bore portion 237*a*. Like stingers 205–208, stinger element 240 has an outwardly projecting flange 243 which seats on surface 211 of collar 209, and an upper end portion 244 which projects upwardly to be received in a corresponding downwardly opening receptacle presented by riser section 14, portion 244** being equipped with sealing rings at 245 to seal with the wall of that receptacle.

As seen in FIG. 13, one end of a flexible hose 246 is connected by a conventional male threaded coupling member 247 to the bottom end of bore 235, the other end of hose 246 being similarly connected to the upper end of a vertical blind bore 248 in the body of piston 99. A radial bore 249 communicates with bore 248 and opens through the outer surface of piston 99 immediately below the seal ring 183 carried by the piston, so that pressure fluid supplied to bore 234 is conveyed to bore 249 and delivered to the space between seal rings 177, 183 to drive piston 99 upwardly relative to handling tool body 90. Bore 239 is similarly connected via a flexible hose (not shown) to a second vertical bore 250 in the body of piston 99 (bore 250 being circumferentially spaced from bore 248). A radial bore 251 communicates with bore 250 and opens through the outer surface of piston 99 in a location which is just below seal ring 177 when the piston is in its uppermost position. Hence, pressure fluid applied to bore 250 enters the space between ring 177 and hub 164 of the piston and drives the piston downwardly, fluid present in the space between rings 177, 183 being exhausted via hose 246 and bore 235.

The radial port 236 communicating with bore 236 opens through the outer surface of member 91 in a location at the upper face of seal ring 129 so that pressure fluid supplied via bore 236 enters the annular space between ring 129 and hub 131 of piston 130 and forces the piston upwardly to disengage skirt 120 from thrust ring 118.

The bottom end of bore 237 is connected by male threaded coupling member 252 and check valve 253 to a conduit 254 connected to valve 255 associated with locator key 115. Valve 255 prevents escape of fluid from conduit 254 when key 115 is in its outer position (as when engaged in slot 12) but allows fluid to escape when key 115 is held in an inner position (as when the key engages the wall of bore 11). Radial bore **237*a* opens through the outer surface of member 91 in a location at the lower face of seal ring 134. Hence, when pressure fluid is supplied via the handling string to bore 237, piston 130 is driven to its lower position, as seen in FIG. 11, and held in that position. Downward operation of piston 130 and simultaneous supply of pressure to valve 255 are the conditions desired during the travel of the handling tool toward and into drilling upper body 10, so that simultaneous supply of pressure fluid from bore 237 to valve 255 and through radial bore 237*a*** is appropriate.

The bottom end of bore 238, FIG. 13, is connected by threaded male member 256 to one end of a conduit 257, the other end of the conduit being connected to elbow 258 and thence to a radial bore 259 extending through member 91 and communicating with a radial bore 260 in member 92, the outer end of bore 260 being plugged. Communication between bores 259 and 260 is established through the annular space 261, FIG. 11A, between concentric wall portions 262, 263 of members 91 and 92, respectively, this space being confined by elastomeric sealing rings 264. The upper end of bore 198, FIGS. 8 and 9, opens into radial bore 260. The upper end of bore 200, FIGS. 8 and 11B, opens into another radial bore (not shown) in member 92 and communicating with annular space 261. Hence, pressure fluid supplied downwardly via bore 238 is conveyed via conduit 257, annular space 261 and bores 198, 200 to all of the eight cylinder bores 190 in splines 101, 102 and therefore drives all of pistons 193 and push rods 194, FIG. 9, downwardly.

Figure 23:
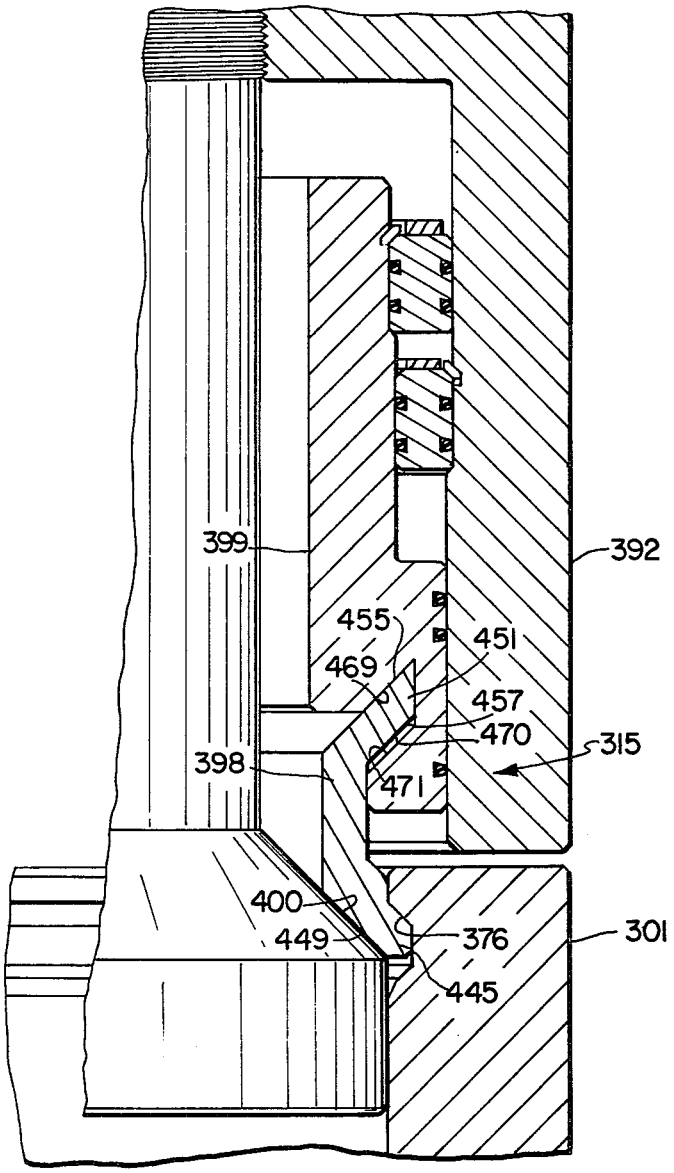
FIG. 23 is a vertical sectional view of a coupling according to another embodiment of the invention.

FIG. 23 shows a coupling according to another embodiment of the invention in which the coupling segments are moved outwardly to engage, inwardly to release. Here, the coupling 315 again includes a generally tubular coupling member 92, an annular piston 399 and a plurality of coupling segments 398. Coupling member 392 can constitute the lower end portion of a handling tool like previously described tool 13. The member 301 to be connected to coupling member 392 is annular and is provided with a transverse annular inwardly opening coupling groove, the upper side wall of which constitutes a frustoconical downwardly and inwardly tapering shoulder 376. Coupling member 392 rigidly carries a central dependent member **392*a* having a transverse annular upwardly facing downwardly and inwardly tapering frustoconical shoulder 400. Piston 399 has an inwardly and downwardly opening transverse annular groove 470 defined by mutually parallel frustoconical downwardly and inwardly tapering side walls 469 and 471 which are spaced apart adequately to slidably accommodate upper end portions 451 of segments 398, upper portions 451 having frustoconical upper and lower faces 455 and 457, respectively, which taper at the same angle as do side walls 469, 471. Compared to segments 98, FIG. 11B, segments 398 are reversed, so that upper portions 451 slant outwardly and upwardly, while lower portions 445** slant outwardly and downwardly.

When members 301, 392 are in endwise engagement, the annular space between shoulders 376 and 400 is of adequate axial width to freely accommodate lower portions 445 of coupling segments 398, and piston 399 can therefore be driven downwardly to cause lower segment portions 445 to enter between shoulders 376 and 400, as shown. In this regard, lower face 449 of lower segment portions 445 are always in sliding engagement with shoulder 400, so that downward movement of the piston causes a camming action between faces 455 and 469 and between face 449 and shoulder 400 so that the segments are cammed outwardly as they move downwardly with the piston. When the load to be suspended is applied to member 301, lower segment portions 445 are clamped in compression between shoulders 376 and 400 to transmit the load to coupling member 392.

What is claimed is:

1. In a remotely operated coupling for connecting a load to an upper member from which the load is to be suspended, the combination of a first member to be connected to the load, the first member having a first frustoconical shoulder;

a coupling member;

means carried by the coupling member and having a second frustoconical shoulder which can be spaced below the first shoulder so as to be parallel thereto with the first and a second shoulder then being spaced apart to define an annular space;

a piston disposed within said coupling member and having a transverse annular segment-retaining groove defined by frustoconical upper and lower side walls which are mutually parallel and spaced apart axially of the coupling member, the side walls of the segment-retaining groove lying in frustoconical planes which slant downwardly to intersect the frustoconical planes of the first and second shoulders;

a plurality of arcuate coupling segments, each of the coupling segments being of generally C-shaped radial cross section and including an upper portion defined by mutually parallel frustoconical upper and lower faces, a lower portion defined by mutually parallel frustoconical upper and lower faces, and an intermediate portion joining the upper and lower portions, the angle of taper of the frustoconical upper and lower faces of the upper portion being the same as the angle of taper of the frustoconical side walls of the segment-retaining groove of the piston, the angle of taper of the frustoconical upper and lower faces of the lower portion being the same as the angle of taper of the first and second shoulders, the coupling segments being arranged in an annular series with the upper portions of the segments slidably disposed in the segment-retaining groove of the piston;

means carried by the coupling member and having surface portions defining an annular recess of generally C-shaped radial cross section disposed to receive the coupling segments when the segments are moved radially away from the piston;

means carried by the coupling member and presenting surfaces coacting with the piston to define expansible chambers; and means for supplying pressure fluid selectively to the expansible chambers to selectively drive the piston upwardly and downwardly relative to the coupling member;

the lower portions of the coupling segments being dimensioned to enter the space between the first and second shoulders when, as the piston is driven downwardly while the lower faces of the lower portions of the segments engage a second shoulder, application of a downward load to the first member then causing the lower portions of the coupling segments to be clamped between the first and second shoulders and the load to be transferred to the coupling member via the first and second shoulders and the lower portions of the segments.

2. The combination defined in claim 1, wherein the second shoulder tapers downwardly and inwardly; and the segment-retaining groove in the piston opens downwardly and outwardly.

3. The combination defined in claim 1, wherein the second shoulder tapers downwardly and outwardly; and the segment-retaining groove in the piston opens downwardly and inwardly.

4. The combination defined in claim 1, wherein the coupling member is tubular and surrounds the piston; the piston comprises an annular outwardly projecting hub embraced by an inner surface portion of the coupling member and equipped with means establishing a fluid-tight seal between the hub and the coupling member, and a portion extending upwardly from the hub and presenting a cylindrical outer surface spaced inwardly from the surrounding wall of the coupling member;

the means carried by the coupling member and presenting surfaces coacting with the piston comprises a first ring secured to the wall of the coupling member, embracing the cylindrical outer surface of the piston and equipped with means establishing a fluid-tight seal between the first ring and the piston, a second ring being attached to the upper portion of the piston above the ring to close the annular space between the piston and the wall of the coupling member.

5. The combination defined in claim 4, wherein the piston includes a lower portion located below the hub and includes the segment-retaining groove.

6. The combination defined in claim 5, wherein the lower portion of the piston has a cylindrical surface spaced inwardly from the surrounding portion of the wall of the coupling member;

the segment-retaining groove opens downwardly and outwardly;

the second shoulder tapers downwardly and inwardly; and the annular recess of C-shaped radial cross section is formed in the wall of the coupling member and opens inwardly.

7. The combination defined in claim 1, and further comprising means secured to the coupling member and slidably engaging the coupling segments to move in directions parallel to the second shoulder.

8. The combination defined in claim 7, wherein the last-mentioned means comprises a plurality of guide pins rigidly secured to the coupling member and projecting inwardly therefrom at the angle of inclination of the second shoulder, and a plurality of guide apertures disposed each in a different one of the coupling segments and oriented to slidably receive the corresponding guide pin.

9. The combination defined in claim 1, wherein the coupling member is carried by a handling tool and is tubular;

the first member is a hanger member to be manipulated by the handling tool;

the piston is annular; and the handling tool further comprises at least one stinger extending downwardly through the piston to engage in an upwardly opening receptacle in the hanger member, the piston being free to move upwardly and downwardly relative to the at least one stinger.

10. The combination defined in claim 9, wherein the first member is a multiple string tubing hanger; and the handling tool comprises a plurality of stingers each extending downwardly through the piston.

11. The combination defined in claim 9, wherein the handling tool is generally tubular throughout its length; and the means for supplying pressure fluid to selectively drive the pistons comprises a plurality of flexible conduits extending through the space within the generally tubular handling tool and connected to the piston.

12. The combination defined in claim 1, wherein the coupling member forms part of a handling tool and is tubular at its lower end;

the first member is a well component to be manipulated by the handling tool;

the first shoulder is the downwardly and inwardly tapering upper side wall of an outwardly opening groove in the well component;

the second shoulder tapers downwardly and inwardly and is provided in the lower end portion of the wall of the coupling member;

the segment-retaining groove of the piston opens downwardly and outwardly; and the annular recess of C-shaped radial cross section is formed in the wall of the coupling member and opens inwardly.

13. The combination defined in claim 12, wherein the second shoulder is a continuation of the lower wall of the annular recess.

14. The combination defined in claim 12, wherein the first member is a multiple string tubing hanger;

the handling tool is generally tubular throughout its length and further comprises a plurality of stingers extending downwardly through the piston and having lower ends spaced below the second shoulder to engage in upwardly opening receptacles in the tubing hanger.

* * * * *